US007873303B2

(12) United States Patent
Ohta et al.

(10) Patent No.: US 7,873,303 B2
(45) Date of Patent: Jan. 18, 2011

(54) UPPER FRAME OPENING AND CLOSING MECHANISM, AND IMAGE FORMING APPARATUS USING THE SAME

(75) Inventors: Yoshihide Ohta, Kanagawa (JP); Takuji Takahashi, Kanagawa (JP); Takamasa Shiraki, Kanagawa (JP); Shigeo Nanno, Kyoto (JP); Takayuki Andoh, Kanagawa (JP); Kohji Hatayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 392 days.

(21) Appl. No.: 12/010,261

(22) Filed: Jan. 23, 2008

(65) Prior Publication Data

US 2008/0175620 A1 Jul. 24, 2008

(30) Foreign Application Priority Data

Jan. 24, 2007 (JP) ..... 2007-013578
Jul. 9, 2007 (JP) ..... 2007-180236
Nov. 7, 2007 (JP) ..... 2007-289284

(51) Int. Cl.
*G03G 21/16* (2006.01)

(52) U.S. Cl. ..... 399/125; 16/375; 399/405

(58) Field of Classification Search ..... 399/125, 399/405; 16/375, 369, 368, 366, 364, 363, 16/362, 361, 360, 359, 358, 357, 306, 304, 16/302, 294, 293, 277, 289
See application file for complete search history.

(56) References Cited

U.S. PATENT DOCUMENTS 4,641,947 A * 2/1987 Ishida et al. ..... 399/125
6,690,901 B2 2/2004 Katsuyama et al.
7,263,312 B2 * 8/2007 Park ..... 399/124
7,360,278 B2 * 4/2008 Jang et al. ..... 16/357
7,369,794 B2 * 5/2008 Kawai et al. ..... 399/125
7,388,593 B2 6/2008 Fukuda
7,421,228 B2 9/2008 Tomura
7,433,629 B2 10/2008 Tomatsu
7,764,905 B2 * 7/2010 Ohta et al. ..... 399/125

FOREIGN PATENT DOCUMENTS

JP 04-053988 U 5/1992
JP 04-143771 5/1992
JP 5-045948 2/1993

(Continued)

*Primary Examiner*—Constantine Hannaher
(74) *Attorney, Agent, or Firm*—Harness, Dickey & Pierce, P.L.C.

(57) ABSTRACT

An upper frame opening and closing mechanism, including an upper frame pivotally attached to a main body, which may include an image forming device, so as to open and close on a hinge, which receives a moment in an opening direction due to gravity when the upper frame is opened at an angle exceeding an inversion angle to expose the image forming device, an arm member, a rail member to guide a leading edge of the arm member along with opening and closing of the upper frame, a biasing member to bias the upper frame in the opening direction, and a cushion member to be pressed by the leading edge of the arm member so as to cushion the opening of the upper frame when the upper frame is opened at a maximum opening angle relative to the main body.

22 Claims, 33 Drawing Sheets

FOREIGN PATENT DOCUMENTS

| | | | |
|---|---|---|---|
| JP | 05-197225 | | 8/1993 |
| JP | 5-330713 | | 12/1993 |
| JP | 8-99749 | | 4/1996 |
| JP | 2706860 | B2 | 10/1997 |
| JP | 11-038714 | | 2/1999 |
| JP | 2001-022143 | | 1/2001 |
| JP | 3176411 | | 4/2001 |
| JP | 2001-343880 | | 12/2001 |
| JP | 2002-361975 | | 12/2002 |
| JP | 2002-365864 | | 12/2002 |
| JP | 2003-058019 | | 2/2003 |
| JP | 3418308 | B2 | 4/2003 |
| JP | 3430868 | B2 | 5/2003 |
| JP | 3446928 | B2 | 7/2003 |
| JP | 3477026 | B2 | 9/2003 |
| JP | 2004-264500 | | 9/2004 |
| JP | 2004-279691 | | 10/2004 |
| JP | 2004-354832 | | 12/2004 |
| JP | 2005-020374 | | 1/2005 |
| JP | 2005-167801 | | 6/2005 |
| JP | 2005-182032 | | 7/2005 |
| JP | 2005-242267 | | 9/2005 |
| JP | 2005-301154 | | 10/2005 |
| JP | 2006-065188 | | 3/2006 |
| JP | 2006-089165 | | 4/2006 |
| JP | 2006-119236 | | 5/2006 |
| JP | 2006-119474 | | 5/2006 |
| JP | 2006-184530 | | 7/2006 |
| JP | 3830091 | B2 | 7/2006 |
| JP | 2006-208910 | | 8/2006 |
| JP | 2006-227064 | | 8/2006 |
| JP | 2006-240848 | | 9/2006 |
| JP | 2006-276620 | | 10/2006 |
| JP | 2006-279877 | | 10/2006 |
| JP | 2006-330356 | | 12/2006 |

* cited by examiner

Background Art

UPPER FRAME OPENING AND CLOSING MECHANISM, AND IMAGE FORMING APPARATUS USING THE SAME

PRIORITY STATEMENT

The present patent application claims priority from Japanese Patent Application Nos. 2007-013578, filed on Jan. 24, 2007 in the Japan Patent Office, 2007-180236, filed on Jul. 9, 2007 in the Japan Patent Office, and 2007-289284, filed on Nov. 7, 2007 in the Japan Patent Office, the entire contents of each of which are hereby incorporated herein by reference.

BACKGROUND

1. Technical Field

Example embodiments generally relate to an image forming apparatus using an electrophotographic, method, such as a copying machine, a printer, a facsimile machine, and a multifunction apparatus that combines the functions of the copying machine, the printer, and the facsimile machine. For example, example embodiments may be effectively employed in a tandem type full-color image forming apparatus. In addition, example embodiments generally relate to an upper frame opening and closing mechanism used in the image forming apparatus in which an upper frame including an image reading device, an automatic document feeder, an optical device, and so forth, is opened and closed relative to a main body including an image forming device.

2. Description of the Related Art

A related-art image forming apparatus, such as a copying machine, a facsimile machine, a printer, or a multifunction printer having two or more of copying, printing, scanning, and facsimile functions, forms a toner image on a recording medium (e.g., a sheet) according to image data using an electrophotographic method. In such a method, for example, a charger charges a surface of an image carrier (e.g., a photoconductor). An optical device emits a light beam onto the charged surface of the photoconductor to form an electrostatic latent image on the photoconductor according to the image data. The electrostatic latent image is developed with a developer (e.g., a toner) to form a toner image on the photoconductor. A transfer device transfers the toner image formed on the photoconductor onto a sheet. A fixing device applies heat and pressure to the sheet bearing the toner image to fix the toner image onto the sheet. The sheet bearing the fixed toner image is then discharged from the image forming apparatus.

In such an image forming apparatus, a toner is consumed over time and is usually resupplied by replacing a toner cartridge. For example, the image forming apparatus includes a main body including an image forming device, and an upper frame including an image reading device, an automatic document feeder, an optical device, and so forth. The upper frame is pivotally attached to the main body, so that the upper frame can be opened and closed relative to the main body on a hinge. The image forming device in the main body is exposed when the upper frame is opened upward, so that a waste toner cartridge can be easily replaced with a new one. Moreover, jammed sheets can be easily removed by opening the upper frame.

However, in a tandem type full-color image forming apparatus in which toner cartridges of four colors are provided in the main body, the upper frame must open wide in order to take all four toner cartridges out of the main body. Also in an image forming apparatus in which a user can perform all operations from a front side thereof, the upper frame must open wide in order to take toner cartridges out of the main body from the front side of the image forming apparatus.

To meet the above-described requirements, a related-art image forming apparatus includes an arm member, a base end of which is pivotally mounted on the upper frame, and a rail member for guiding a leading edge of the arm member along with opening and closing of the upper frame, provided on the main body. The related-art image forming apparatus further includes a biasing member for biasing the upper frame in an opening direction so that the upper frame can be widely and stably opened.

However, in the related-art image forming apparatus described above, when the user releases the upper frame during the opening motion before an opening angle of the upper frame exceeds an inversion angle θ, which is an opening angle of the upper frame when a center of gravity G of the upper frame reaches a vertical surface V passing a fulcrum F as illustrated in FIG. 38A, the upper frame receives a moment in a closing direction due to gravity. Consequently, the upper frame 30 returns to a closed position, and collides with the main body with great force as illustrated in FIG. 38B, possibly causing injury and damage. On the other hand, when the user releases the upper frame during the opening motion when the opening angle of the upper frame exceeds the inversion angle θ, the upper frame receives a moment in an opening direction due to gravity. As a result, the upper frame is opened backward due to gravity as illustrated in FIG. 38C, and may collide with a person or an object behind the image forming apparatus. The weight of the upper frame increases if the upper frame includes the image reading device, for example, the automatic document feeder, the optical device, and so forth, thus exacerbating the aforementioned problem. Accordingly, the upper frame may be pivotally opened backward with great force, possibly causing injury, large noise, and damage to components.

To solve such problems, another relate-art image forming apparatus includes one or both of a pivot spring provided to the hinge, and an arm spring provided to the base end of the arm member. The pivot spring biases the upper frame in the opening direction at first when the upper frame is opened, and reversely biases the upper frame in the closing direction during the opening motion. The arm spring pivotally biases the arm member, and initially applies a moment to the arm member in the opening direction when the upper frame is opened, and reversely applies a moment to the arm member in the closing direction during the opening motion. With such a configuration, the upper frame can be prevented from being fully opened and closed with great force, preventing injury and damage. In addition, an impact caused by the opening and closing of the upper frame can be cushioned.

However, in the above-described configuration, prevention of damage and impact caused by the opening and closing of the upper frame is performed by a single spring having functions of both of the pivot spring and the arm spring, such as a torsion spring. Therefore, it is difficult to adjust the pivot spring and the arm spring to reliably prevent injury and damage caused by the opening and closing of the upper frame, as well as to securely reduce the impact.

SUMMARY

Example embodiments provide an upper frame opening and closing mechanism and an image forming apparatus using the same, in which injury, damage, and impact possibly caused by releasing the upper frame during opening of the upper frame can be reliably prevented with a compact configuration and lower costs.

At least one embodiment provides an upper frame opening and closing mechanism including an upper frame pivotally attached to a main body including an image forming device so as to be opened and closed on a hinge, which receives a moment in an opening direction due to gravity when the upper frame is opened at an angle exceeding an inversion angle so as to expose the image forming device, an arm member, a base end of which is pivotally mounted on the upper frame, a rail member mounted on the main body, to guide a leading edge of the arm member along with opening and closing of the upper frame, a biasing member to bias the upper frame in the opening direction, and a cushion member provided to an end edge of the rail member to be pressed by the leading edge of the arm member so as to cushion the opening motion of the upper frame when the upper frame is opened at a maximum opening angle relative to the main body.

At least one embodiment provides an upper frame opening and closing mechanism including an upper frame pivotally attached to a main body including an image forming device so as to be opened and closed on a hinge, which receives a moment in an opening direction due to gravity when the upper frame is opened at an angle exceeding an inversion angle so as to expose the image forming device, an arm member, a base end of which is pivotally mounted on the upper frame, a rail member mounted on the main body, to guide a leading edge of the arm member along with opening and closing of the upper frame, and a biasing member to bias the upper frame in the opening direction. A moment applied to the upper frame based on a biasing force from the biasing member is set so as to balance with the moment applied to the upper frame based on gravity when the upper frame is opened at a maximum opening angle relative to the main body, except beginning and ending of the opening motion.

At least one embodiment provides an image forming apparatus including an image bearing member to bear an electrostatic latent image, a charging device to charge a surface of the image bearing member, an irradiating device to irradiate the charged surface of the image bearing member to form an electrostatic latent image thereon, a developing device to develop the electrostatic latent image with a toner to form a toner image, a transfer device to transfer the toner image onto a recording medium, and the upper frame opening and closing mechanism described above.

Additional features and advantages of the example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
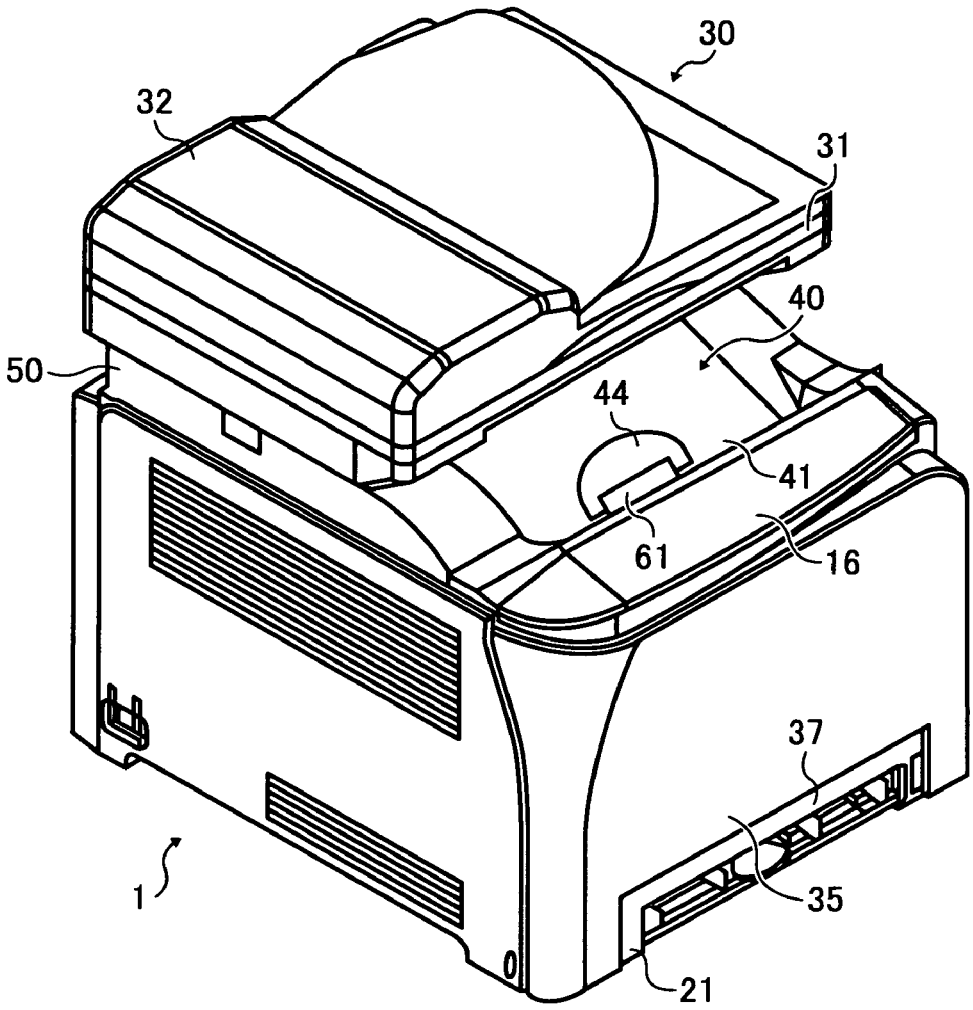
FIG. 1 is an external perspective view illustrating an image forming apparatus according to example embodiments.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of example embodiments.

The terminology used herein is for the purpose of describing example embodiments only and is not intended to be limiting. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner. Reference is now made to the drawings, wherein like reference numerals designate identical or corresponding parts throughout the several views.

FIG. 1 is an external perspective view illustrating a compact tandem type full-color image forming apparatus for home use according to example embodiments (hereinafter referred to as an "image forming apparatus"). A user can normally perform all operations from a front side of the image forming apparatus, which corresponds to a right front portion of FIG. 1. Reference numeral 1 denotes a main body of the image forming apparatus, and reference numeral 30 denotes an upper frame pivotally attached to the main body 1. The upper frame 30 can be pivotally opened and closed from the front side thereof relative to the main body 1 on a pivot provided at the back of the image forming apparatus to be described later.

The main body 1 includes a control panel 16 on the top of the front side thereof. The main body 1 further includes a front cover 35 at the front which can be pulled open. A pull-out opening 37 of a paper feed tray 21 is provided at the bottom of the front cover 35.

The upper frame 30 includes a sheet stacking surface 41 for storing discharged sheets having images thereon, and an upper cover 40 including supporting convex parts 50 protruding upward from right and left sides of the sheet stacking surface 41. The upper frame 30 further includes an image reading device 31 for reading image data, on the supporting convex parts 50 of the upper cover 40, and an automatic document feeder 32 for automatically feeding documents to the image reading device 31. Both still documents, and moving documents automatically fed by the automatic document feeder 32, can be read by the image reading device 31. The sheet stacking surface 41 includes a fan-like shaped concave portion 44 at the front, and a grip 61 of a lock lever 60 to be described later is provided to the fan-like shaped concave portion 44.

Figure 2:
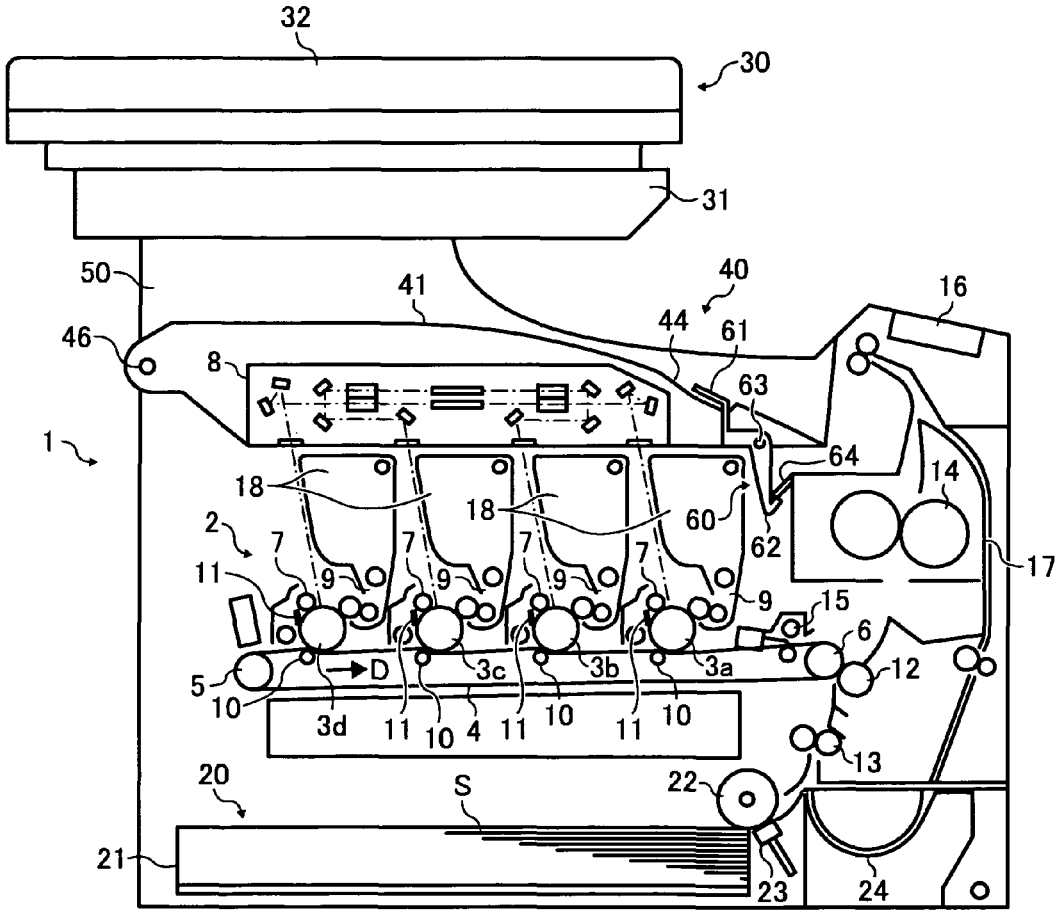
FIG. 2 is a schematic view illustrating an inner structure of the image forming apparatus illustrated in FIG. 1.

FIG. 2 is a schematic view illustrating an inner structure of the image forming apparatus illustrated in FIG. 1. The main body 1 includes a full-color image forming device 2 in which four image forming stations are arranged in tandem. Each of the image forming stations includes drum-type photoconductors 3*a*, 3*b*, 3*c*, and 3*d* (hereinafter collectively referred to as a "photoconductor 3") serving as an image bearing member, and yellow, cyan, magenta, and black toner images is formed on each of the photoconductor 3. Each of the photoconductor 3 is arranged in parallel at predetermined intervals. An intermediate transfer belt 4 serving as an intermediate transfer member is arranged below the photoconductor 3 so as to face the photoconductor 3. Although a drum-type intermediate transfer member can also be used, the intermediate transfer belt 4 described here includes as an endless belt stretched by a plurality of supporting rollers 5 and 6, and is driven in a direction indicated by an arrow D in FIG. 2.

A charging device 7 for charging a surface of the photoconductor 3, a developing device 9 for visualizing an electrostatic latent image formed by irradiation on the surface of the photoconductor 3, a transfer device 10 facing the photoconductor 3 with the intermediate transfer belt 4 therebetween, and a cleaning device 11 for removing and collecting residual toner particles on the surface of the photoconductor 3 after a toner image is transferred onto the intermediate transfer belt 4, are provided around the photoconductor 3. In each of the image forming stations, a toner cartridge 18 of each color is provided in the respective developing device 9 so as to be replaced with new one from above the main body 1. Above the toner cartridge 18, a laser scanning device 8 for irradiating the surface of the photoconductor 3 with a laser beam to write image data thereon is provided in the upper cover 40. The laser scanning device 8 is elastically supported by the upper cover 40, so that the toner cartridge 18 is elastically pushed in the main body 1 by the laser scanning device 8 when the upper cover 40 is closed.

When an image formation operation is started in the image forming apparatus, the photoconductor 3 is rotated in a clockwise direction in FIG. 2, and the charging device 7 charges the surface of the photoconductor 3 to a predetermined polarity. Subsequently, the laser scanning device 8, based on image data, irradiates the charged surface of the photoconductor 3 with a laser beam to form an electrostatic latent image on the surface of the photoconductor 3. The developing device 9 applies a toner to the electrostatic latent image formed on the surface of the photoconductor 3 to form a toner image. Thereafter, the transfer device 10 transfers the toner image onto the intermediate transfer belt 4.

In color image formation, toner images of yellow, cyan, magenta, and black respectively formed on the photoconductor 3 are sequentially transferred onto the intermediate transfer belt 4 so as to be superimposed on one another on the intermediate transfer belt 4. A secondary transfer roller 12 is further provided facing the supporting roller 6 with the intermediate transfer belt 4 therebetween.

A paper feeder 20 provided below the image forming unit 2 includes the paper feed tray 21 for storing a sheet S such as a transfer sheet and resin film, a paper feed roller 22 for feeding the sheet S stored in the paper feed tray 21, a friction pad 23 for separating the sheet S one by one, a retransferring path 24 used for duplex printing, and so forth.

The sheet S fed from the paper feeder 20 is conveyed to a registration roller 13, and a leading edge of the sheet S reaches the registration roller 13 at rest so that the sheet S can be set in an adjusted position. Thereafter, the registration roller 13 restarts rotating to convey the sheet S to a secondary transfer device including the secondary transfer roller 12, such that a color toner image formed on the intermediate transfer belt 4 and the sheet S are appropriately overlapped in the secondary transfer device.

The sheet S onto which the color toner image is transferred by the secondary transfer device is conveyed to a fixing device 14, and the fixing device 14 fixes the color toner image to the sheet S. Thereafter, the sheet S having the fixed color toner image thereon is discharged to the sheet stacking surface 41 provided above the main body 1. Residual toner particles adhering to the surface of the intermediate transfer belt 4 after the color toner image is transferred onto the sheet S are removed by a belt cleaner 15.

When duplex printing is performed, the sheet S to which the toner image is fixed by the fixing device 14 is reversed and conveyed through a paper refeed path 17. Subsequently, the sheet S is conveyed to the secondary transfer device again through the retransferring path 24, and a toner image is transferred onto a back side of the sheet S. Thereafter, the toner image is fixed onto the back side of the sheet S, and the sheet S is discharged to the sheet stacking surface 41.

The control panel 16 provided in the main body 1 controls operations performed by the image reading device 31 and the image forming device 2. The control panel 16 is provided on the front side of the image forming apparatus. In the image forming apparatus according to example embodiments, the sheet S discharged to the sheet stacking surface 41 is discharged from the front to the back.

In example embodiments, the two supporting convex parts 50 protruding upward are provided along the right and left edges of the upper cover 40. However, the supporting convex part 50 is not provided along a back edge of the upper cover 40. With such a configuration, a portion of the sheet S having a length longer than a front-to-back length of the sheet stacking surface 41 protrudes over the edge of the sheet stacking surface 41 and droops backward, and consequently, the sheet S can be stacked on the sheet stacking surface 41 with no difficulty. Moreover, although the image reading device 31 provided above the sheet stacking surface 41 shades the sheet stacking surface 41, the supporting convex part 50 is not provided along the back edge of the upper cover 40 so that light comes into the sheet stacking surface 41 from the back side of the upper cover 40.

Figure 3:
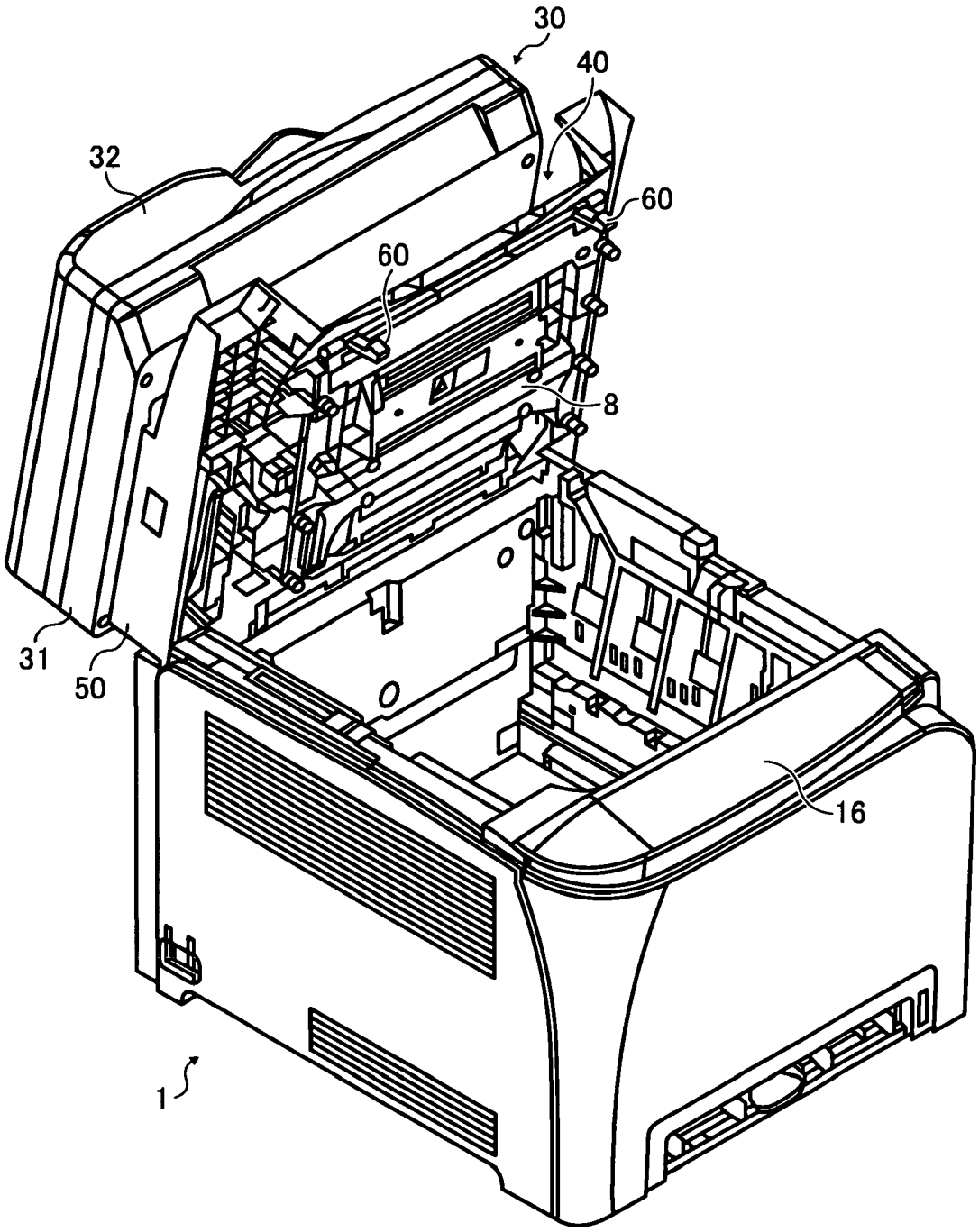
FIG. 3 is an external perspective view illustrating the image forming apparatus when an upper frame is opened relative to a main body.
Figure 4:
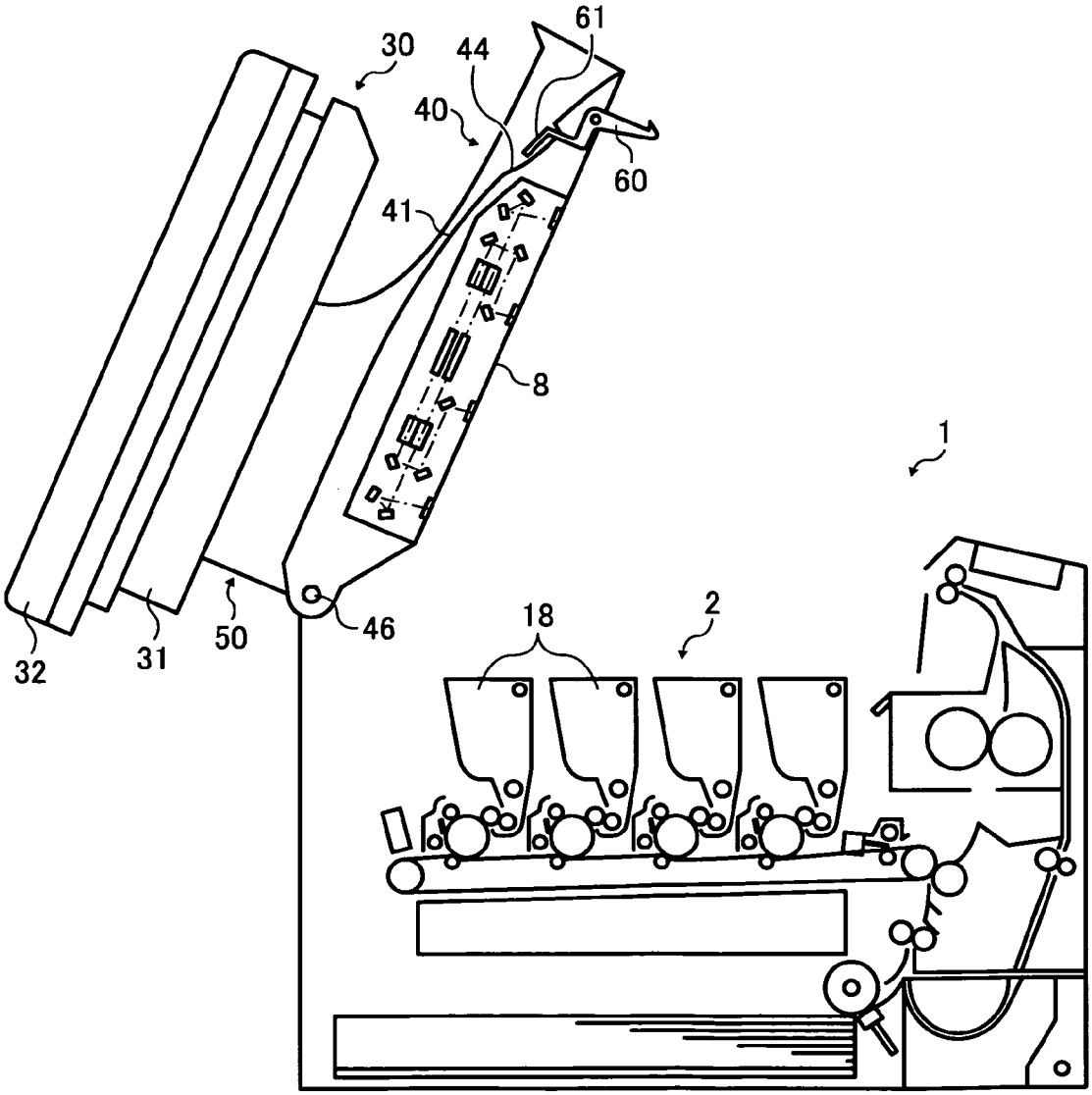
FIG. 4 is a schematic view illustrating the inner structure of the image forming apparatus when the upper frame is opened relative to the main body.

FIG. 3 is an external perspective view illustrating the image forming apparatus when the upper frame 30 is opened relative to the main body 1. In FIG. 3, the main components of the image forming apparatus such as the photoconductor 3, the charging device 7, the developing device 9, the cleaning device 11, and so forth included in the image forming unit 2, are removed for convenience. FIG. 4 is a schematic view illustrating the inner structure of the image forming apparatus when the upper frame 30 is opened relative to the main body 1.

Referring to FIGS. 3 and 4, the upper cover 40 is locked to the main body 1 with the lock lever 60 to be described in detail later. When the lock lever 60 is released, the upper cover 40 can be pivotally opened relative to the main body 1 along with the upper frame 30 as illustrated in FIGS. 3 and 4. Accordingly, the laser scanning device 8 provided on the bottom of the upper cover 40, the image reading device 31 attached to the supporting convex parts 50 of the upper cover 40, and the automatic document feeder 32 provided above the image reading device 31 are also pivoted upward along with the opening of the upper frame 30. As a result, the user can easily access the image forming unit 2 in the main body 1, facilitating maintenance work such as replacement of the toner cartridge 18 and removal of jammed sheets.

When the upper frame 30 is pivotally opened, the back edge of the sheet stacking surface 41 faces downward. In other words, if the sheet S is stacked and left on the sheet stacking surface 41 when the upper frame 30 is opened upward, the sheet S falls off the back of the image forming apparatus. The sheet S can be prevented from falling off by providing the supporting convex part 50 to the back edge of the upper cover 40. However the sheet S having a length longer than the front-to-back length of the sheet stacking surface 41 contacts the supporting convex part 50 provided along the back edge of the upper cover 40, consequently, the sheet S cannot be properly stacked on the sheet stacking surface 41.

To solve the above-described inconvenience, in the example embodiments, the grip 61 for releasing the lock lever 60 to allow the upper frame 30 to be opened upward is provided on the sheet stacking surface 41 at a position covered by the stacked sheet S. Referring back to FIG. 2, the lock lever 60 has the grip 61 at an upper edge thereof, and a lock claw 62 for engaging with a protrusion 64 of the main body 1 at a lower edge thereof, and is pivotally supported on a pin 63. The grip 61 of the lock lever 60 has a plate-like shape, and is provided along the sheet stacking surface 41. The fan-like shaped concave portion 44 is formed on the sheet stacking surface 41 so that the user can easily reach the grip 61. When opening the upper frame 30 upward, the user inserts a hand from the fan-like shaped concave portion 44 and pulls up on the grip 61, so that the lock lever 60 pivots on the pin 63 clockwise, and the lock claw 62 is released from the protrusion 64. Thereafter, as the user lifts the grip 61 further, the upper frame 30 pivots on a hinge 46 to be described later.

Because the grip 61 for releasing the lock lever 60 to allow the upper frame 30 to be opened upward is provided on the sheet stacking surface 41 on which the sheet S is to be stacked, the user can easily check whether or not the sheet S is stacked on the sheet stacking surface 41 before opening the upper frame 30. Therefore, the upper frame 30 can be reliably prevented from being opened when the sheet S is stacked on the sheet stacking surface 41.

Figure 5:
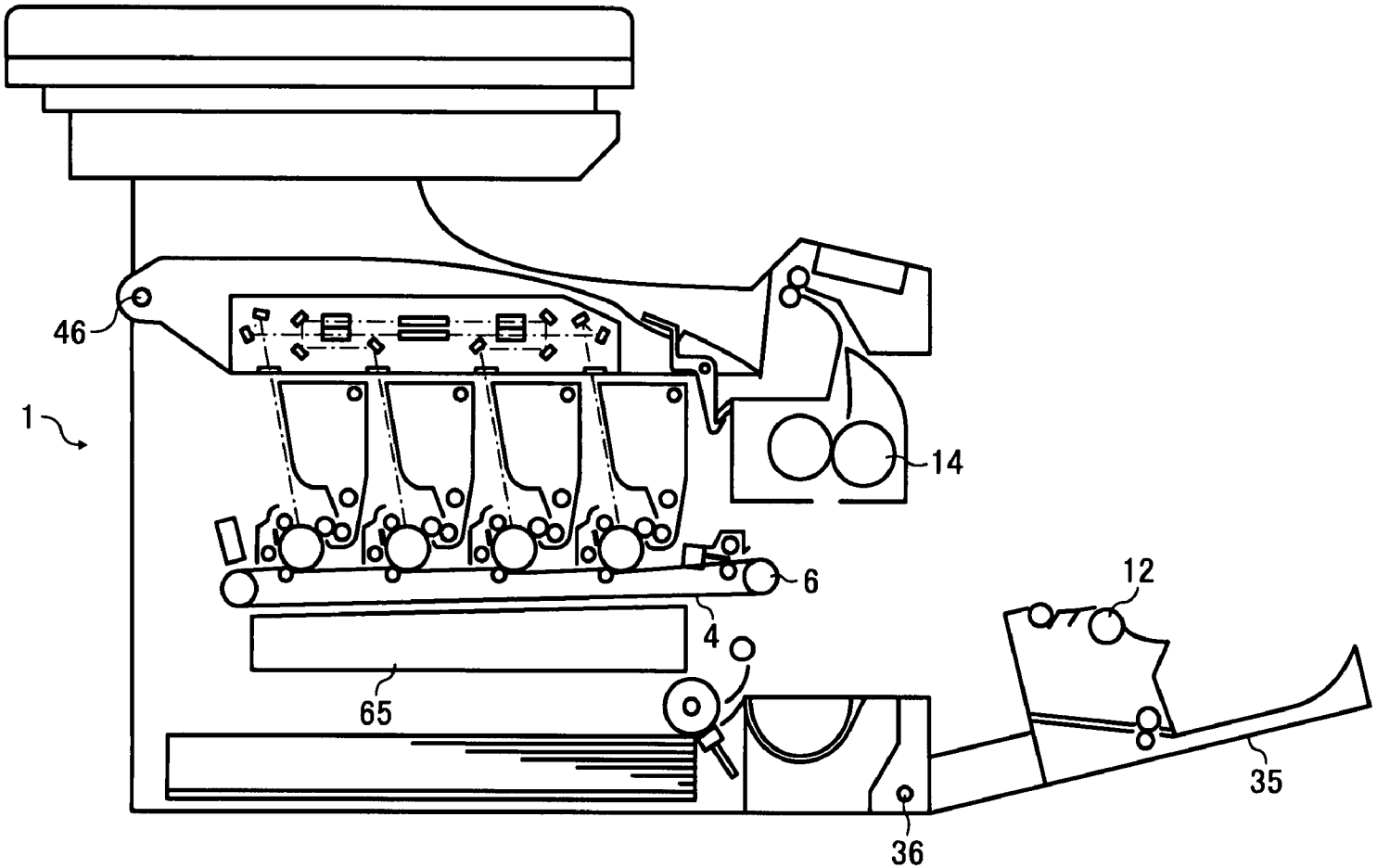
FIG. 5 is a schematic view illustrating the inner structure of the image forming apparatus when a front cover provided to the main body is pulled open.

FIG. 5 is a schematic view illustrating the inner structure of the main body 1 when the front cover 35 is pulled open. Referring to FIG. 5, the front cover 35 is pivotally provided to the main body 1 on a hinge 36 so as to be pulled open and closed relative to the main body 1. The user can easily access the inner components of the main body 1 by pulling open the front cover 35, and easily perform maintenance work such as replacement of the intermediate transfer belt 4, a waste toner bottle 65, and the fixing device 14, and removal of jammed sheets from sheet transfer paths in the main body 1.

Figure 6:
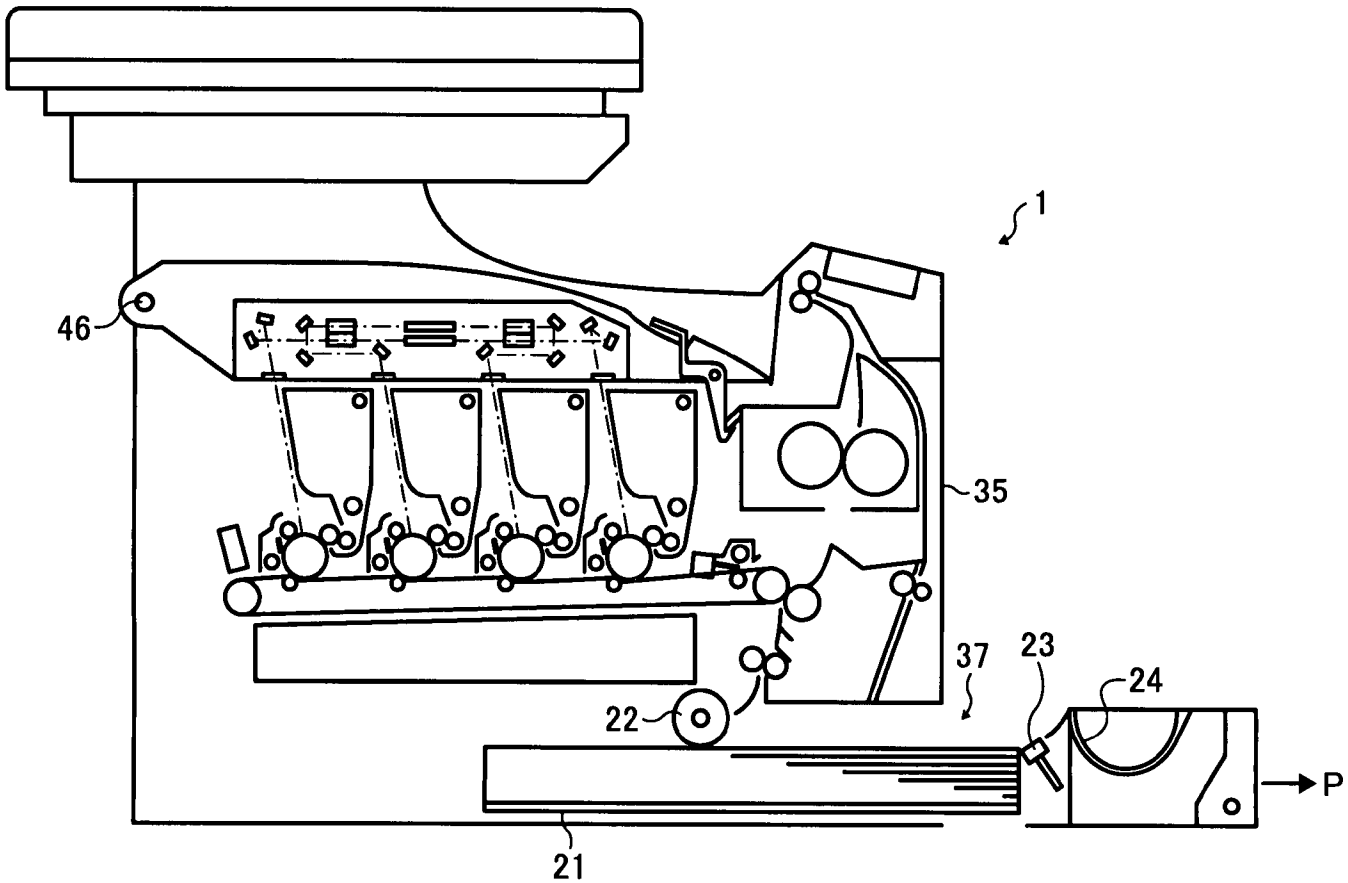
FIG. 6 is a schematic view illustrating the inner structure of the image forming apparatus when a paper feed tray is pulled out from the main body.

FIG. 6 is a schematic view illustrating the inner structure of the main body 1 when the paper feed tray 21 is pulled out from the main body 1. Referring to FIG. 6, the front cover 35 has the pull-out opening 37 of the paper feed tray 21. The paper feed tray 21 can be attached to and detached from the main body 1 from the front side of the main body 1 by pulling out of the pull-out opening 37 in a horizontal direction in FIG. 6. Thus, the user can easily perform maintenance and replacement of the components as well as removal of jammed sheets from the front side of the main body. As a result, a space for performing such operations is not necessary on right, left, and back sides of the main body 1, resulting in a reduction in installation space. This leads to provision of a lower-cost image forming apparatus having excellent usability. It should be noted that, in the example embodiments, when the paper feed tray 21 is pulled out of the main body 1 in a direction indicated by an arrow P in FIG. 6, the friction pad 23 and the retransferring path 24 are pulled out of the main body 1 together with the paper feed tray 21 whereas the paper feed roller 22 remains inside the main body 1.

Accessibility to the sheet S, strength for supporting the upper frame 30, and a cushion mechanism are described in detail below along with a description about configurations of the supporting convex parts 50 and the upper frame 30 with reference to FIGS. 7 through 9.

Figure 7:
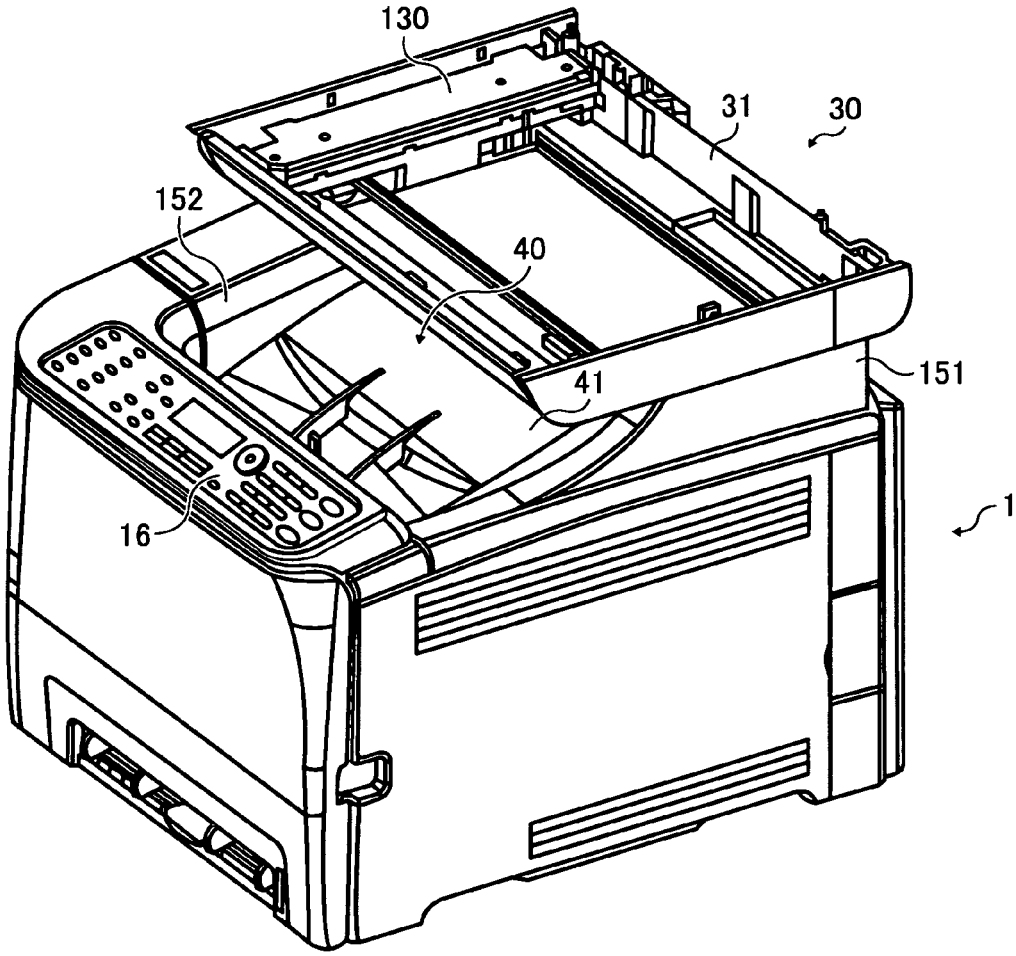
FIG. 7 is a perspective view illustrating an inner structure of an image reading device employed in the image forming apparatus.
Figure 8:
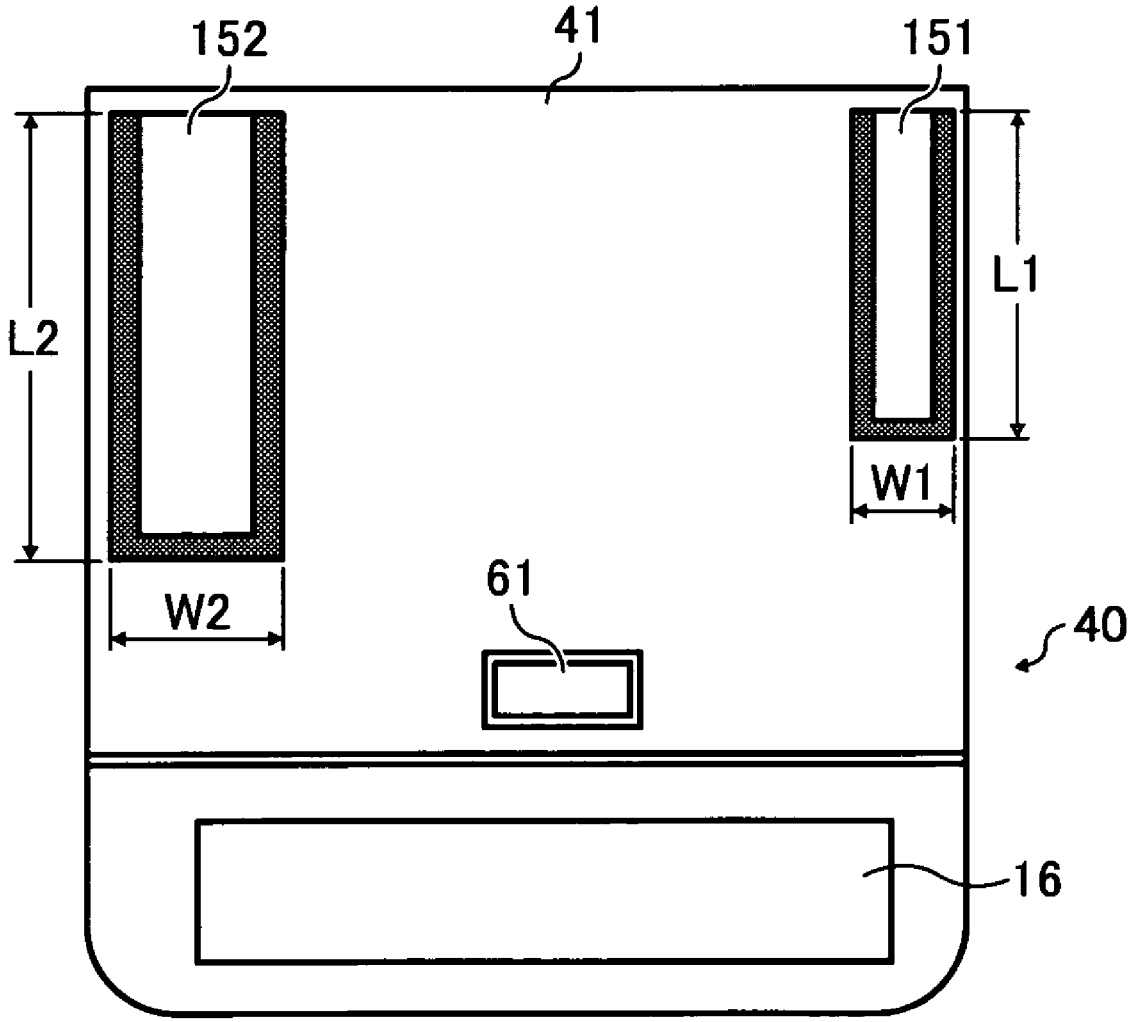
FIG. 8 is a schematic plan view illustrating supporting convex members provided in right and left portions of the image forming apparatus.

Referring to FIG. 7, the image reading device 31 above which the automatic document feeder 32 is provided includes an optical movable module 130. The optical movable module 130 faces a supporting convex member 152 included in the supporting convex parts 50 located on a left portion of the upper cover 40 when viewed from the front. The automatic document feeder 32 includes a document turning part on the left portion thereof when viewed from the front, so that a document stacking tray and a document discharge tray, both of which are not illustrated, can be opened from the right side.

Because the optical movable module 130 including a scanning unit and a carriage is located on the left portion of the image reading device 31, the image reading device 31 is heavily weighted to the left portion thereof. To remedy such an unbalance, a supporting convex member 151 included in the supporting convex parts 50 located on a right portion of the upper cover 40 is formed smaller than the supporting convex member 152 as illustrated in FIG. 8. Moreover, with such a configuration, a right-handed user can easily take the sheet S discharged to the sheet stacking surface 41 from the right side. For the above-described reasons, the supporting convex member 151 located on the right portion of the upper cover 40, to which a smaller weight is applied from the image reading device 31, is formed smaller than the supporting convex member 152. In addition, the supporting convex member 151 has a base portion provided lower than that of the supporting convex member 152. The above-described configuration provides convenience for the user, for example, the right-handed user.

Figure 9:
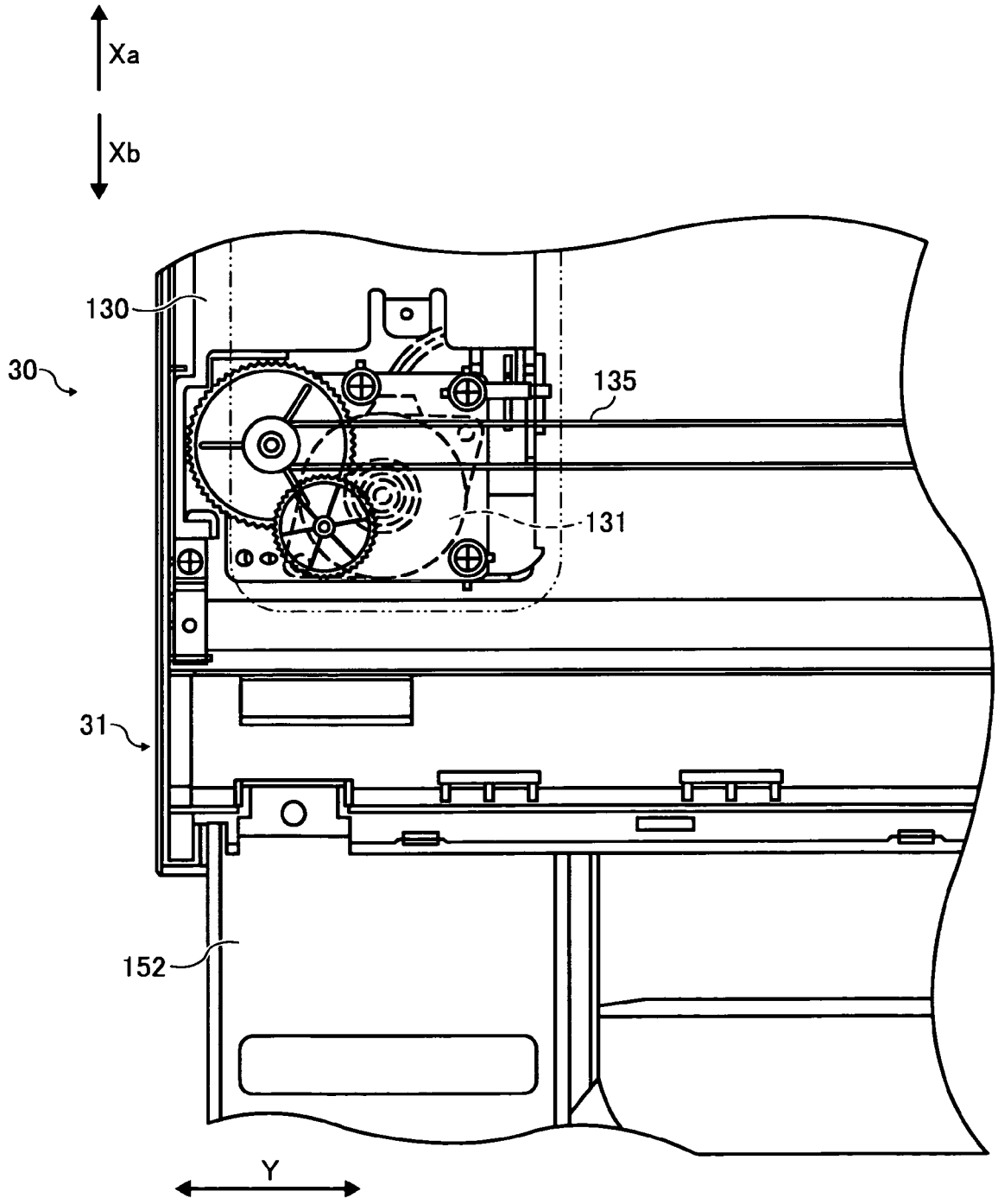
FIG. 9 is a schematic cross-sectional view illustrating allocation of a driving motor in the image reading device when the image reading device is positioned at a front edge of the supporting convex members.

Referring to FIG. 9, a driving motor 131 serving as a driving system of the image reading device 31, a driving transmission system including gears, and so forth, are also provided on the left portion of the image reading device 31 when viewed from the front. As described above, the image reading device 31 includes a scanning unit, not shown, for reading a set document, and the driving motor 131 for driving the scanning unit. The driving motor 131 transmits a driving force to the scanning unit via a timing belt 135 and so forth.

As described above, the image reading device 31 above which the automatic document feeder 32 is provided is asymmetrical when viewed from the front. In order to bear the heavier weight, the supporting convex member 152 located on the left is formed larger than the supporting convex member 151 located on the right. Accordingly, the weight applied from the image reading device 31 to the upper cover 40 can be balanced. For example, referring back to FIG. 8, a length L1 of the supporting convex member 151 and a length L2 of the supporting convex member 152 are set to satisfy a relation of L1<L2. In addition, a width W1 of the supporting convex member 151 and a width W2 of the supporting convex member 152 are set to satisfy a relation of W1<W2. With such a configuration, accessibility to the sheet S discharged to the sheet stacking surface 41 is dramatically improved.

The supporting convex members 151 and 152 including a sliding mechanism for slidably supporting the image reading device 31 in a front-and-back direction of the main body 1, namely, a sheet discharging direction Xa indicated by an arrow Xa, and a sliding direction Xb indicated by an arrow Xb, are described in detail below with reference to FIGS. 10 to 12.

Figure 10:
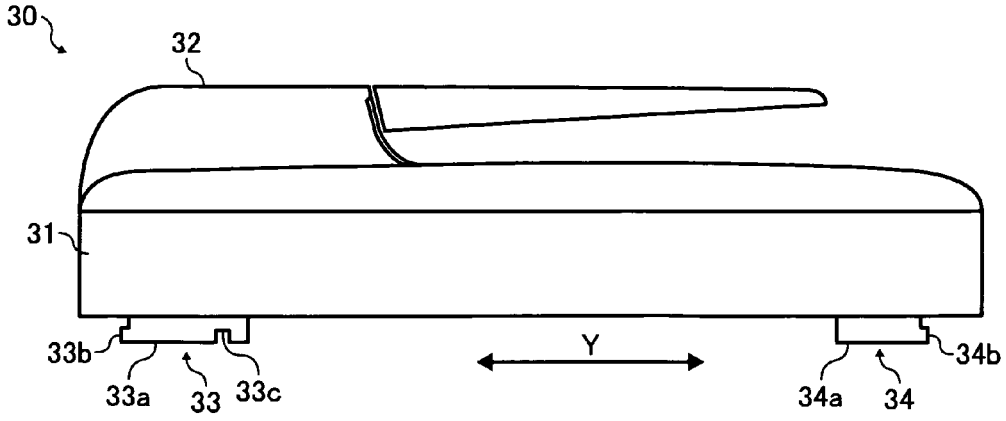
FIG. 10 is a front view illustrating the image reading device.

Referring to FIG. 10, each of rails 33 and 34 serving as a sliding member is integrally formed at the bottom of each of the left and right portions of the image reading device 31. The rails 33 and 34 respectively include lower surfaces 33*a* and 34*a*, and protrusions 33*b* and 34*b*. The rail 33 located on the left includes a groove 33*c* extending in the sheet discharging direction Xa.

Figure 11:
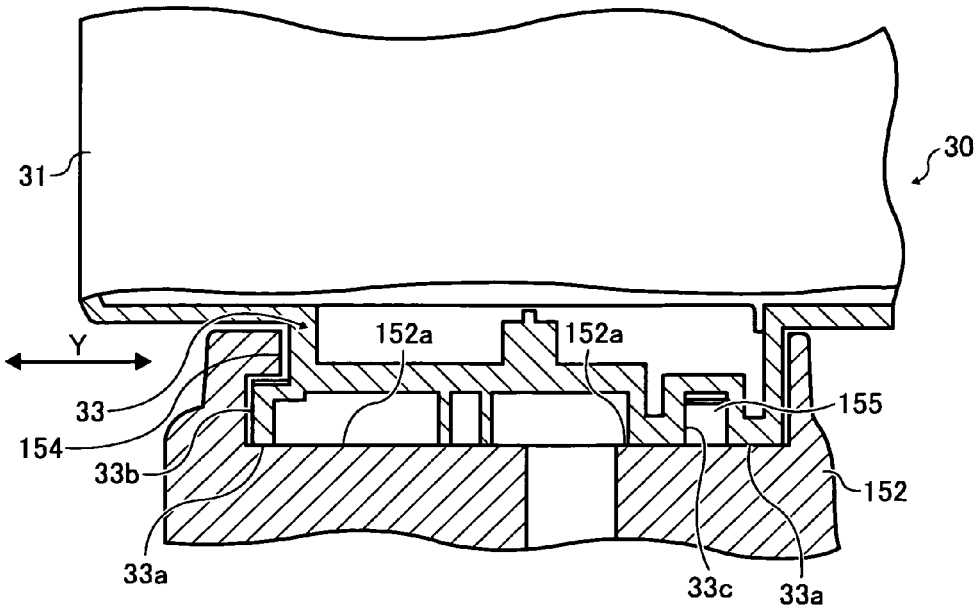
FIG. 11 is a cross-sectional view illustrating a rail provided to the image reading device slidably fitted into a slip prevention member located on the left.
Figure 12:
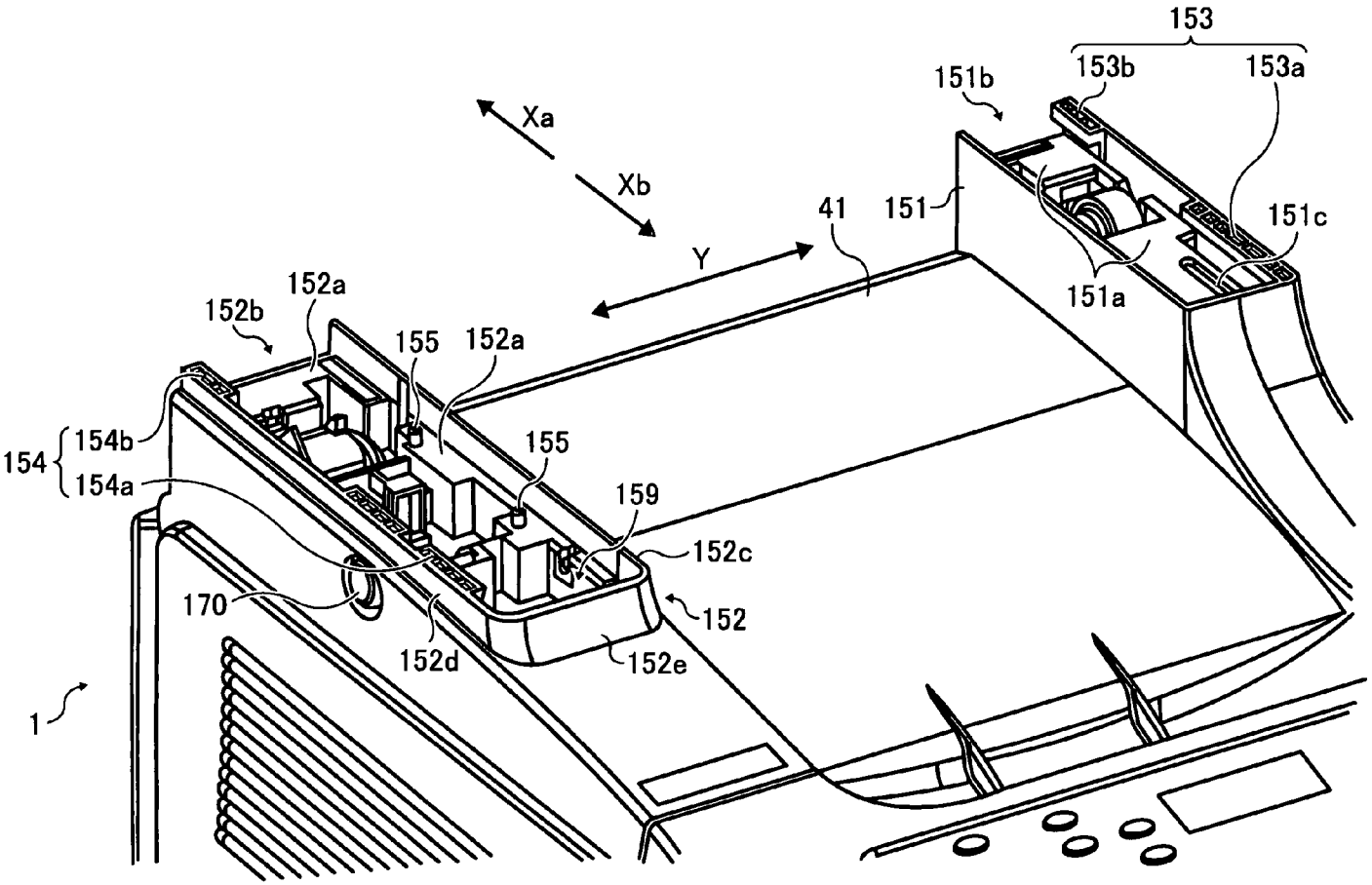
FIG. 12 is a perspective view illustrating the supporting convex members and the slip prevention members.

Referring to FIGS. 10 to 12, the image reading device 31 is slidably supported by the lower surfaces 33*a* and 34*a* respectively provided to the rails 33 and 34 so as to be slid into upper surfaces 152*a* and 151*a* respectively provided to the supporting convex members 152 and 151. A gap in a horizontal direction between the image reading device 31 and the upper cover 40 is controlled by fitting two pins 155 protruding upward from the supporting convex member 152 into the groove 33*c* provided to the rail 33 of the image reading device 31 with a predetermined space therebetween.

Each of slip prevention members 153 and 154 having a U shape integrally formed with each of the upper surfaces 151*a* and 152*a*, is provided on an external side of each of the supporting convex members 151 and 152. The slip prevention members 153 and 154 respectively provided on the supporting convex members 151 and 152 are fitted into the protrusions 34*b* and 33*b*, each protruding from each of the rails 34 and 33 of the image reading device 31, with a predetermined space therebetween so as to prevent the image reading device 31 from upward slipping and unstable attachment, and to control a gap in a horizontal direction between the image reading device 31 and the upper cover 40.

Alternatively, each of the slip prevention members 153 and 154 may be provided on an internal side of each of the supporting convex members 151 and 152, and each of the protrusions 33*b* and 34*b* may be provided on an internal side of each of the rails 33 and 34 of the image reading device 31. Thus, the slip prevention members 153 and 154 are fitted into the protrusions 34*b* and 33*b* with a predetermined space therebetween so as to prevent the image reading device 31 from upward slipping and unstable attachment, and to control a gap in a horizontal direction between the image reading device 31 and the upper cover 40.

As described above, each of the rails 33 and 34 is integrally formed with a casing of the image reading device 31, so that the lower surfaces 33*a* and 34*a* respectively provided to the rails 33 and 34 are slid into the upper surfaces 152*a* and 151*a* respectively provided to the supporting convex members 152 and 151, achieving a lower-cost sliding mechanism without additional components. Moreover, the above-described cross-sectional shapes of the rails 33 and 34 can provide sufficient strength to the rails 33 and 34 as well as the image reading device 31.

Because each of the slip prevention members 153 and 154 is integrally formed with each of the supporting convex members 151 and 152, the image reading device 31 can be prevented from upward slipping without additional components and increased cost. Moreover, the load applied to the slip prevention members 153 and 154 can be received by both of the supporting convex members 151 and 152 respectively provided on the right and left portions of the upper cover 40, providing sufficient strength to the slip prevention members 153 and 154. As a result, the image reading device 31 can be stably attached to the upper cover 40 even when a force is unevenly applied to the image reading device 31.

If each of the slip prevention members 153 and 154 is provided on both the external and internal sides of each of the supporting convex members 151 and 152, a space for allocating other components is limited. Because the supporting convex members 151 and 152 are required to include components such as a mechanism for cushioning the opening and closing of the upper frame 30, provision of smaller slip prevention members is more preferable. According to the example embodiments, each of the slip prevention members 153 and 154 is provided on either one of the external and internal sides of each of the supporting convex members 151 and 152. Therefore, the slip prevention members 153 and 154 can be made strong without wasting space.

Referring to FIG. 12, each of the slip prevention members 153 and 154 includes slip prevention portions 153*a* and 154*a* provided at the front of each of the supporting convex members 151 and 152, and slip prevention portions 153*b* and 154*b* provided at the back of each of the supporting convex members 151 and 152. Therefore, when a force is applied to the front portion of the image reading device 31, the force can be received by the slip prevention portions 153*a* and 154*a* respectively provided at the front of the supporting convex members 151 and 152. In contrast, when a force is applied to the back portion of the image reading device 31, the force can be received by the slip prevention portions 153*b* and 154*b* respectively provided at the back of the supporting convex members 151 and 152. Accordingly, unstable attachment of the image reading device 31 to the upper cover 40 can be reliably prevented. Furthermore, because each of the slip prevention portions 153*a* and 154*a* is provided separately from each of the slip prevention portions 153*b* and 154*b*, other components can be allocated therebetween in each of the slip prevention members 153 and 154.

Figure 13:
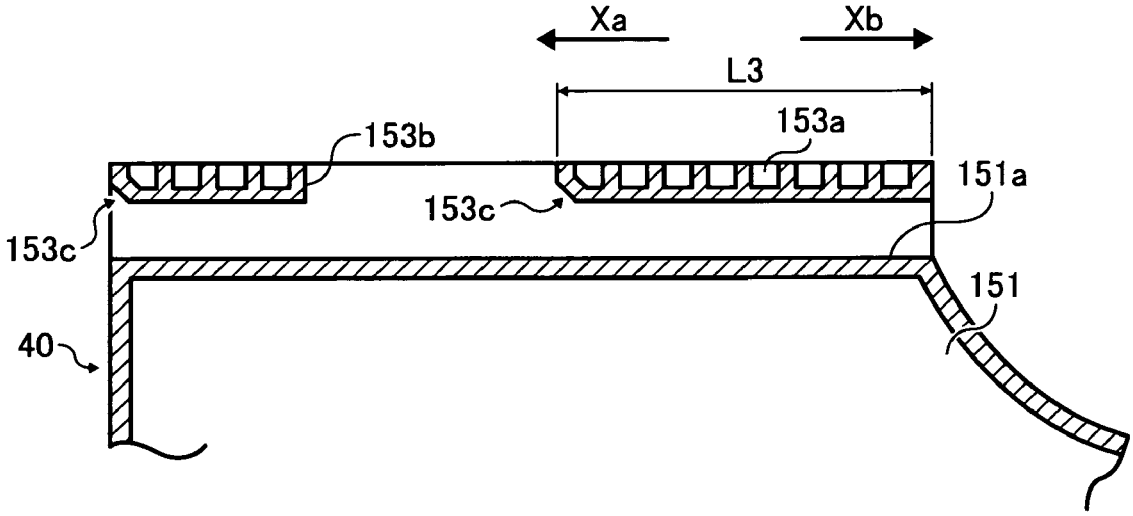
FIG. 13 is a cross-sectional view illustrating the slip prevention member provided in the supporting convex member located on the right.

Referring to FIG. 13, each of the slip prevention portions 153*a* and 153*b* includes a tapered portion 153*c* at each of rear edges thereof relative to the sliding direction Xb. Although not illustrated, each of the slip prevention portions 154*a* and 154*b* includes a tapered portion in a same manner as described above. Therefore, the leading edges of the rails 33 and 34 are not stuck with the slip prevention portions 153*a*, 153*b*, 154*a*, and 154*b* when the image reading device 31 is slid in the sliding direction Xb. It is preferable to provide a tapered portion on the leading edge of each of the rails 33 and 34, for example, a tapered portion 33*d* illustrated in FIG. 17. Accordingly, the leading edges of the rails 33 and 34 are not stuck with the slip prevention portions 153*a*, 153*b*, 154*a*, and 154*b* when passing the slip prevention portions 153*a*, 153*b*, 154*a*, and 154*b*, providing smooth sliding of the image reading device 31 in the sliding direction Xb.

As illustrated in FIG. 13, a length L3 of the slip prevention portion 153*a* is set such that the rails 33 and 34 of the image reading device 31 are engaged with the slip prevention portions 154*a* and 153*a* respectively provided at the front of the slip prevention members 154 and 153, and the slip prevention portions 154*b* and 153*b* respectively provided at the back of the slip prevention members 154 and 153, when the image reading device 31 is slid to the back in the sheet discharging direction Xa within a slidable range of the image reading device 31. Accordingly, because the rails 33 and 34 are engaged with the slip prevention portions 154*a* and 153*a* and the slip prevention portions 154*b* and 153*b* as long as the image reading device 31 is positioned within the slidable range, unstable attachment of the image reading device 31 can be reliably prevented.

Referring back to FIG. 12, when the image reading device 31 is attached to the upper cover 40, the rails 33 and 34 of the image reading device 31 are inserted into entries 152*b* and 151*b* respectively provided on the back side of the supporting convex members 152 and 151, so that the image reading device 31 is slid in the sliding direction Xb so as to be attached to the upper cover 40. As illustrated in FIG. 12, the supporting convex member 151 provided on the right portion of the upper cover 40 includes a cutout groove 151*c* having a length identical to that of the maximum sliding stroke of the image reading device 31. After the rails 33 and 34 of the image reading device 31 are inserted into the supporting convex members 152 and 151 provided to the upper cover 40, the upper cover 40 included in the upper frame 30 is opened upward, and the rail 34 of the image reading device 31 is screwed together with a shoulder screw fitted into the cutout groove 151*c* from the reverse side of the upper cover 40, thereby preventing the image reading device 31 from slipping off when being slid in the sheet discharging direction Xa.

As described above, the image reading device 31 is prevented from upward slipping by the slip prevention members 153 and 154. Moreover, the image reading device 31 can be detachably attached to the supporting convex members 151 and 152 provided to the upper cover 40 in the sheet discharging direction Xa, so that the image reading device 31 can be detachably attached to upper cover 40 from the back of the main body 1. The image reading device 31 is also prevented from slipping off from the back side thereof by being screwed together with the shoulder screw.

Therefore, even when the user pulls the image reading device 31 up or slides the image reading device in the sheet discharging direction Xa and the sliding direction Xb, the image reading device 31 can be prevented from slipping off from the supporting convex members 151 and 152 of the upper cover 40, providing safety, strength, and reliability to the image forming apparatus. Moreover, the image reading device 31 can be easily attached to and detached from the upper cover 40 from the back of the main body 1, improving attachment performance.

When the image reading device 31 is designed to be slidable as described above, the image reading device 31 is required to be fixed to the upper cover 40 at a plurality of positions after being slidably attached to the upper cover 40. To meet such a requirement, a lock mechanism is provided to the supporting convex parts 50 of the upper cover 40.

Figure 14:
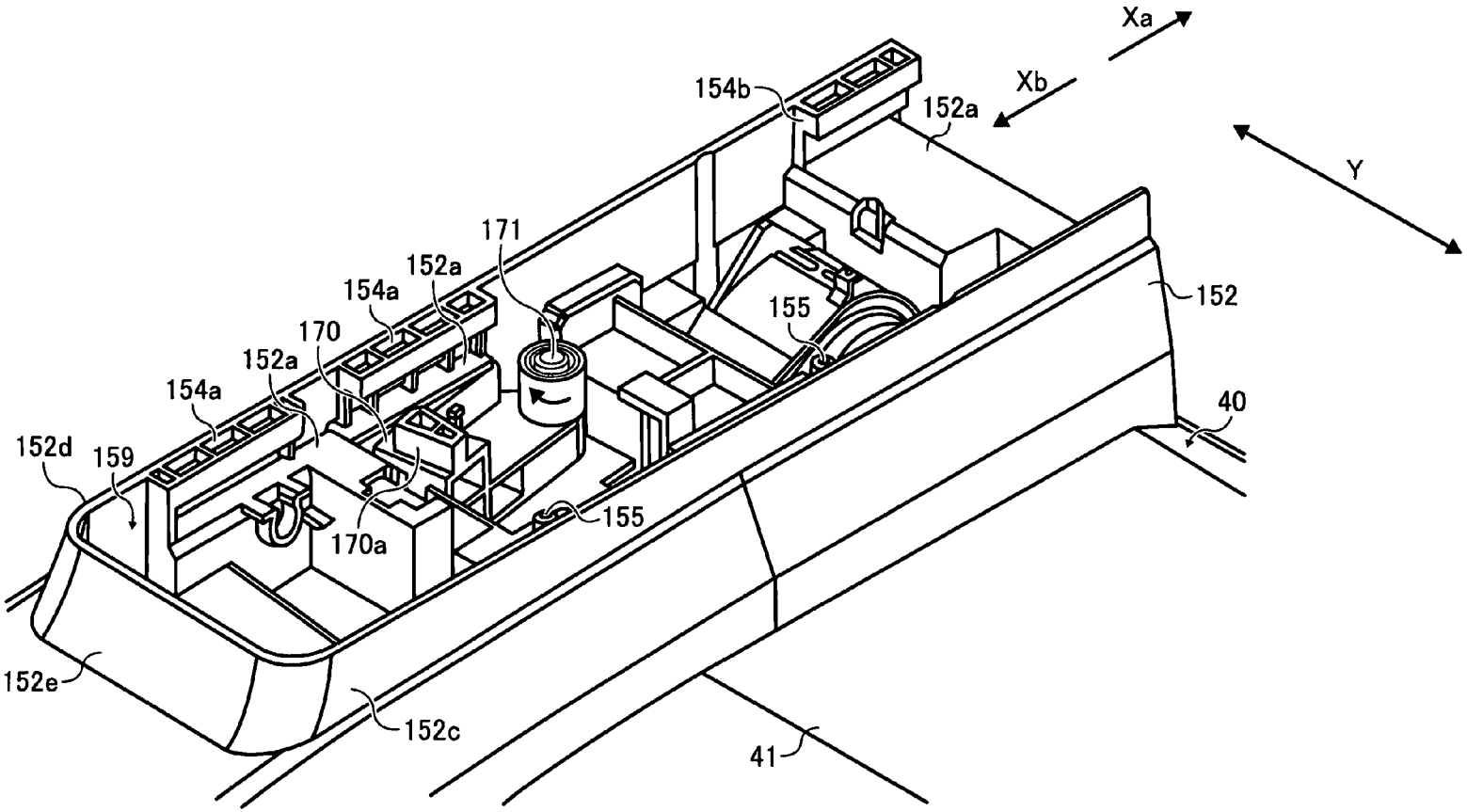
FIG. 14 is a perspective view illustrating a lock mechanism to lock the image reading device, provided in the supporting convex member located on the left.

As described above, each of the supporting convex parts 50 for slidably supporting the image reading device 31 includes each of the supporting convex members 151 and 152, and the supporting convex member 152 provided on the left portion of the upper cover 40 includes the lock mechanism. Referring back to FIG. 12, an operation button 170 is provided on the side surface of the supporting convex member 152. FIG. 14 illustrates an inner structure of the supporting convex member 152 to which the operation button 170 is provided more in detail.

Figure 15:
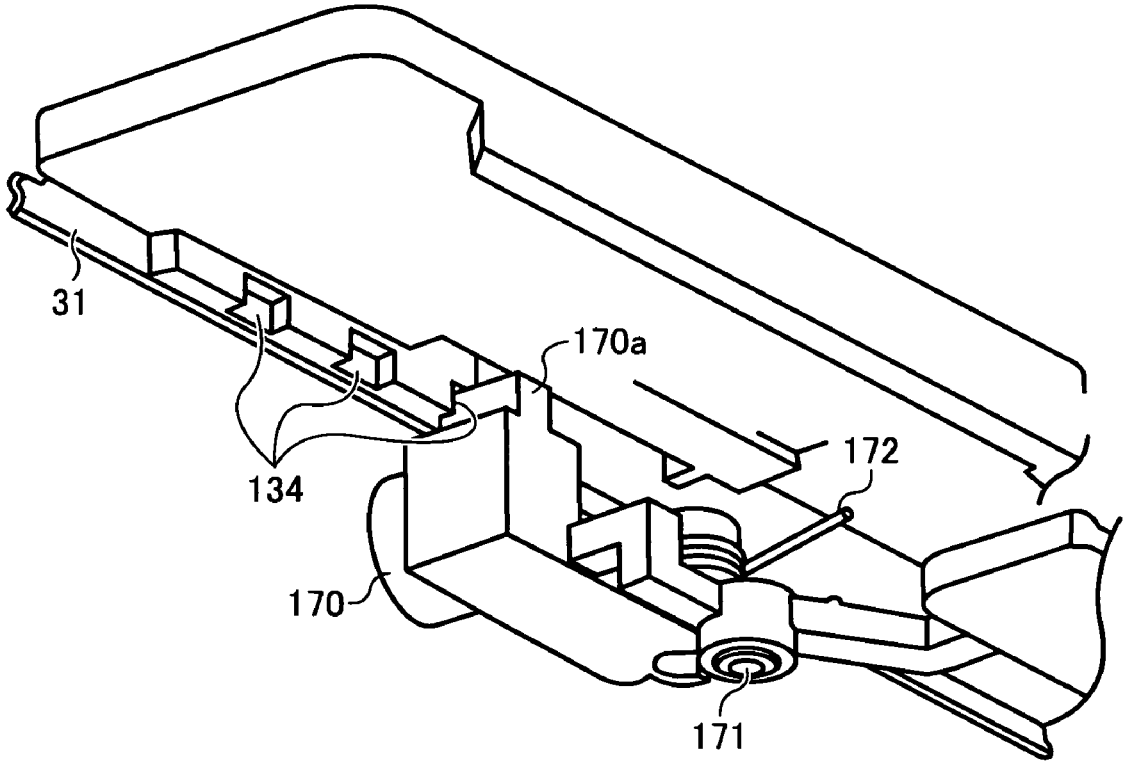
FIG. 15 is a perspective view illustrating main components of the lock mechanism illustrated in FIG. 14.

Referring to FIG. 15, a coil spring 172 is fixed to a shaft 171 of the operation button 170 to bias the operation button 170 toward the outside of the supporting convex member 152. The operation button 170 includes a hook 170*a* for engaging with one of a plurality of cutout portions 134 formed in the rail 33 of the image reading device 31 to lock the rail 33 of the image reading device 31 when the coil spring 172 biases the operation button 170 toward the outside. On the other hand, when the operation button 170 exposing on the side surface of the supporting convex member 152 is pressed in a direction opposite to that of a biasing force of the coil spring 172, the engagement between the hook 170*a* and the cutout portion 134 is released, consequently, the image reading device 31 can be slid. As described above, the plurality of the cutout portions 134 are formed in the rail 33 of the image reading device 31, for example, the rail 33 includes the three cutout portions 134 according to example embodiments. The rail 33 of the image reading device 31 can be locked at each portion where the cutout portions 134 are formed.

As described above, a gap in a horizontal direction between the image reading device 31 and the upper cover 40 can be controlled by fitting the two pins 155 protruding from the supporting convex member 152 of the upper cover 40 into the groove 33*c* formed in the rail 33 of the image reading device 31. Because the supporting convex member 152 includes a variety of components therein, a distance between the two pins 155 is limited. Moreover, in order to keep production costs down, the pins 155 are integrally formed of a plastic material with the sheet stacking surface 41 and the supporting convex members 151 and 152. The groove 33*c* is integrally formed of a plastic material with the casing of the image reading device 31. Specific examples of the plastic materials include a combination of polycarbonate and polystyrene, and so forth. Such plastic materials are appropriately treated with a flame retardant in conformity with regulations of corresponding countries. Because plastic materials easily deform as compared to metal, accuracy in fitting performance of the plastic materials is limited. As a result, even when the rail 33 of the image reading device 31 is locked, a gap in a horizontal direction between the image reading device 31 and the upper cover 40 exists, causing unstable attachment of the image reading device 31 to the upper cover 40.

To solve the above-described problem, according to example embodiments, the supporting convex member 151 also includes the lock mechanism. Because a distance between the two lock mechanisms respectively provided to the supporting convex member 151 located on the right and the supporting convex member 152 located on the left is long enough relative to the width of the upper cover 40, a gap between the image reading device 31 and the upper cover 40 can be minimized.

Figure 16:
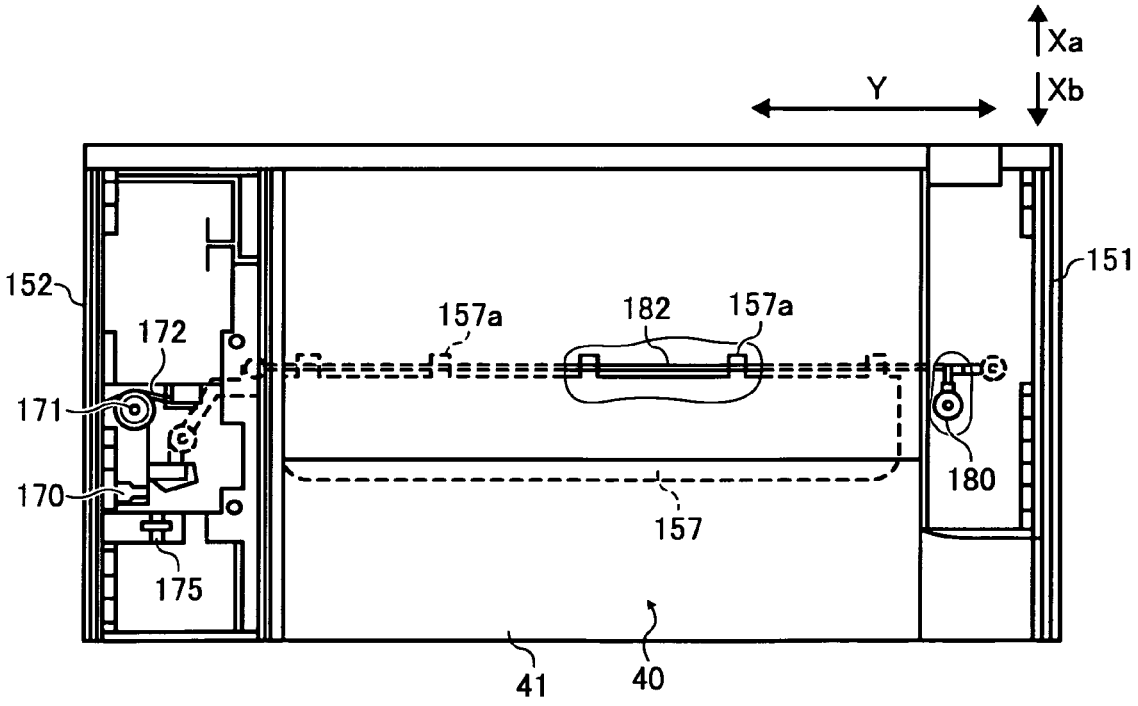
FIG. 16 is a plan view illustrating the lock mechanism provided in the supporting convex members on the right and the left, a part of which is omitted therefrom.
Figure 17:
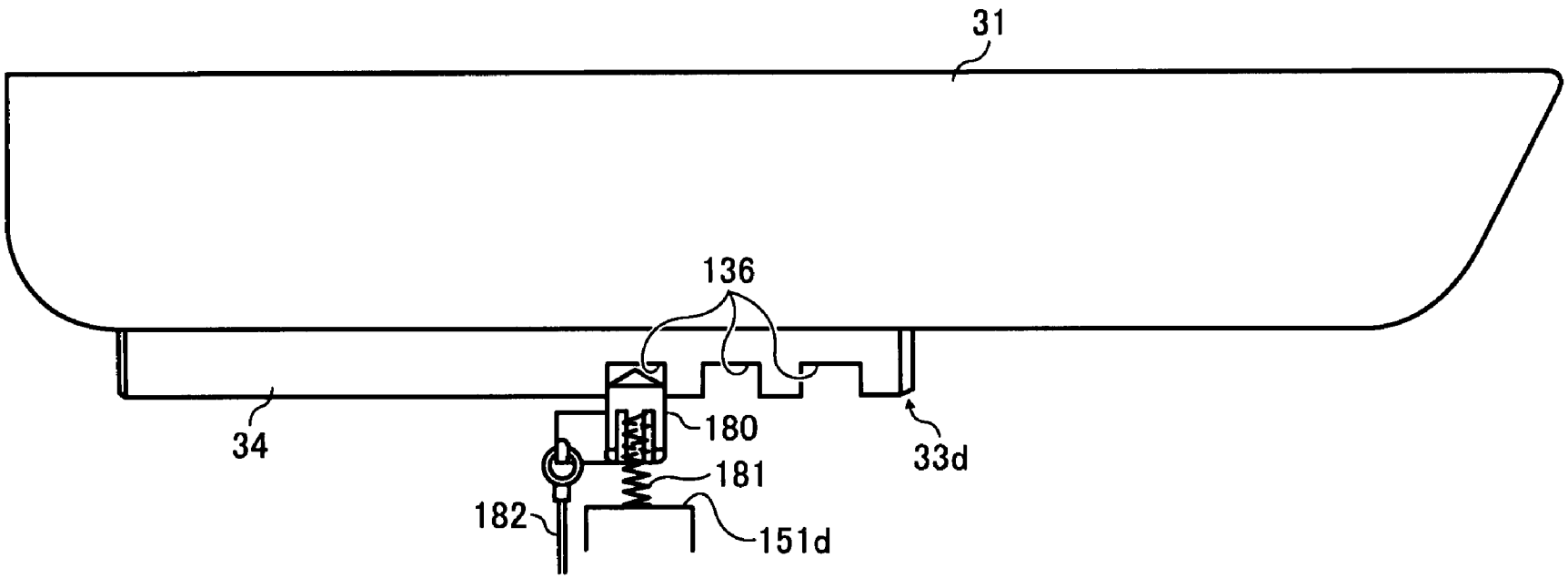
FIG. 17 is a schematic cross-sectional view illustrating the lock mechanism provided in the supporting convex member on the right.

Referring to FIG. 16, the supporting convex member 151 located on the right includes a lock member 180 having a cone-shaped top. Referring to FIG. 17, the lock member 180 is biased upward by a compression spring 181 so as to be engaged with one of grooves 136 formed in the rail 34 of the image reading device 31. An upper edge of the compression spring 181 is locked into a spring lock portion at the bottom of the lock member 180, and a lower edge of the compression spring 181 is locked into a spring lock portion 151*d* provided to the supporting convex member 151. The operation button 170 provided to the supporting convex member 152 on the left and the lock member 180 are connected by a flexible wire 182 as illustrated in FIG. 16. A right edge of the flexible wire 182 is bent forward at a right angle in FIG. 16, and is extended upward to connect a hook lock portion of the lock member 180 as illustrated in FIG. 17. Accordingly, the two lock mechanisms can be simultaneously operated by pressing the operation button 170. Referring back to FIG. 16, the flexible wire 182 is guided by a groove, not shown, provided to a rib on the under surface of the upper cover 40, a plurality of guides 157*a* of a wire pressing member 157 provided to the under surface of the upper cover 40, and so forth, with no slack. Because the flexible wire 182 connects the two lock mechanisms respectively provided to the supporting convex member 151 located on the right and the supporting convex member 152 located on the left, the lock mechanisms can be simultaneously operated in a complex path with a few components in a simple way.

When the lock mechanisms are respectively provided to the supporting convex member 151 located on the right and the supporting convex member 152 located on the left, with the sheet stacking surface 41 located therebetween, the flexible wire 182 is effectively used to transmit operations through a U-shaped path.

Figure 18A:
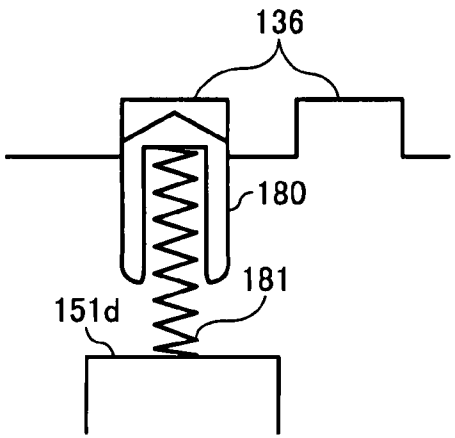
FIGS. 18A to 18C are cross-sectional views illustrating transitional states of engagement of a lock member with a groove.
Figure 18B:
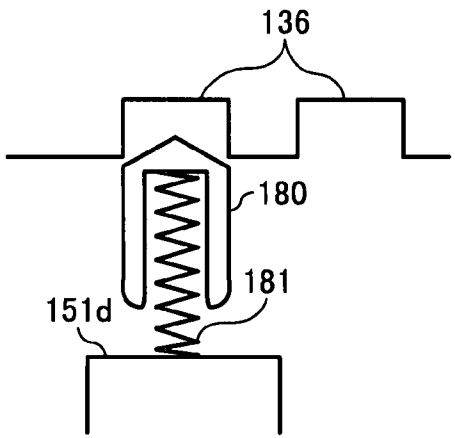
Figure 18C:
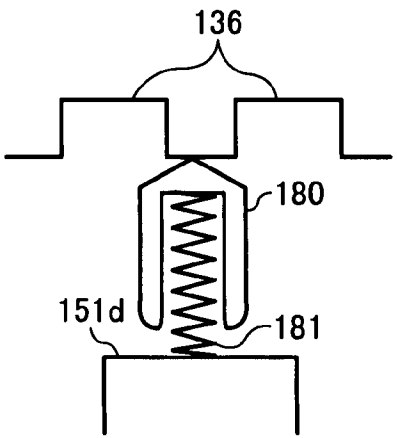

When the operation button 170 is pressed in a direction opposite to that of the biasing force of each of the coil spring 172 and the compression spring 181, the lock member 180 is pulled by the flexible wire 182. As a result, the lock member 180 moves downward from a position illustrated in FIG. 18A, and the engagement between one of the plurality of the grooves 136 formed in the rail 34 of the image reading device 31 and the lock member 180 is released as illustrated in FIG. 18B. At this time, the cone-shaped top of the lock member 180 is still stuck in the groove 136, and therefore the lock member 180 is not entirely released from the groove 136. When the image reading device 31 is slid under such a condition, the groove 136 pushes the lock member 180 down as illustrated in FIG. 18C, so that the user can feel a click. The user can feel a click when the lock member 180 is engaged with the groove 136 as well. Such a configuration notifies the user with a click of a position where the rail 34 of the image reading device 31 is locked.

As described above, the upper frame 30 including the image reading device 31, the sheet stacking surface 41, and the upper cover 40 can be pivotally opened upward from the front on the hinge 46 provided on the back of the image forming apparatus. Therefore, consumables such as the toner cartridge 18, and components such as the intermediate transfer belt 4 in which periodical replacement is needed, can be effectively replaced. When process cartridges are horizontally arranged in the image forming apparatus, the user is required to attach and detach the process cartridges to and from the image forming apparatus from above the image forming apparatus. Therefore, the upper frame 30 is required to be swingable back and forth at 90 degrees relative to the main body 1 so as to open upward. If the user accidentally presses the operation button 170 when the upper frame 30 is opened upward at 90 degrees relative to the main body 1, the lock mechanisms of the upper cover 40 are released, and the image reading device 31 drops under its own weight. To solve such a problem, the slip prevention members 153 and 154 illustrated in FIG. 12 are provided so as to prevent the image reading device 31 from slipping off or dropping off from the supporting convex members 151 and 152 provided to the upper cover 40, and to hold the image reading device 31 attached to the upper cover 40.

Nevertheless, the user may be hit by the image reading device 31 suddenly sliding due to the release of the lock mechanisms, possibly causing injury. The following describes a method of preventing the operation button 170 from accidentally being pressed, and the image reading device 31 from dropping off.

Referring back to FIG. 16, a pendulum 175 is swingably provided to the supporting convex member 152 in a horizontal direction in the vicinity of the operation button 170. When the upper frame 30 is opened upward along with the upper cover 40, the pendulum 175 swings so as to move to a moving path of the operation button 170. Accordingly, the operation button 170 hits the pendulum 175 when the upper frame 30 is opened upward along with the upper cover 40, so that the operation button 170 cannot be pressed to the position for releasing the lock mechanisms. Therefore, the image reading device 31 can be prevented from dropping off under its own weight even if the user accidentally presses the operation button 170 when the upper frame 30 is in the opened position.

Openings and covering members provided in the vicinity of the front edges of the sliding mechanisms, which are the main components of example embodiments, are described in detail below.

As illustrated in FIGS. 10 to 12 above, the image reading device 31 is prevented from slipping upward by fitting each of the rails 33 and 34 respectively provided on the left and right portions of the image reading device 31 into each of the slipping prevention members 154 and 153 respectively provided in the supporting convex members 152 and 151 respectively located on the left and right portions of the upper cover 40. Because the image reading device 31 is slidably attached to the top of the supporting convex members 151 and 152, a load may be applied to the supporting convex members 151 and 152 from the top thereof when the user attaches the image reading device 31 to the upper cover 40. Therefore, the supporting convex members 151 and 152 are required to have a longer length in back and forth direction in order to bear such a load. In addition, the upper surface 152*a* and the slip prevention portion 154*a* are extended to the front edge of the supporting convex member 152 as much as possible in order to bear the load applied by the right-handed user.

As a result, the upper surface 152*a* and the slip prevention portion 154*a*, both of which are formed on the upper surface of the supporting convex member 152 and extended to the front edge of the supporting convex member 152, are exposed when the image reading device 31 is slid to the back of the upper cover 40 to improve visibility of the sheet S stacked on the sheet stacking surface 41. Problems do not occur if the front edge of the upper surface of the supporting convex member 152 is formed in a flat surface. However, if uneven portions such as the upper surface 152*a* and the slip prevention member 154*a* are formed for preventing the image reading device 31 from slipping off from the upper cover 40, the exposure of such portions may cause injury.

One possible idea to solve such a problem is not to form such uneven portions in the front portion of the supporting convex member 152, and to form the front portion of the supporting convex member 152 in a flat surface so that the image reading device 31 is merely placed thereon. In such a case, the flat surface (hereinafter referred to as a "boundary surface") is required to be larger than a portion where the upper surface 152*a* contacts the lower surface 33*a* of the rail 33 of the image reading device 31. Otherwise, front and side areas of the portion where the upper surface 152*a* contacts the lower surface 33*a* are exposed when the image reading device 31 is slid to the back of the upper cover 40. As a result, the user may catch a finger in a gap exposed in the sheet discharging direction Xa and the sliding direction Xb, possibly causing injury.

Accordingly, downsizing of the image reading device 31 is now described in detail. As described above with reference to FIGS. 8 and 9, the image reading device 31 includes the scanning unit, not shown, for reading a set document, and the driving motor 131 for driving the scanning unit. The driving motor 131 transmits a driving force to the scanning unit via the timing belt 135 and so forth.

A thickness of the scanning unit is required to be equal to a moving range thereof, that is, almost equal to a thickness of the image reading device 31. Because the driving motor 131 is fixed to the image reading device 31, an additional thickness is required for a part where the driving motor 131 is positioned, so that it is necessary to extend a part of the image reading device 31 downward. However, if such a part is located above the sheet stacking surface 41, the part may get stuck with the discharged sheets S or the stacked sheets S on the sheet stacking surface 41 when the image reading device 31 is slid. Furthermore, a distance between the image reading device 31 and the sheet stacking surface 41 is reduced, causing a reduction in sheet stacking capacity. However, such a problem can be solved by extending the part of the image reading device 31 to inside of the supporting convex member 152 provided outside of the sheet stacking surface 41.

As described above, part of the image reading device 31 is extended downward in order to downsize the image reading device 31. When the part extending downward is placed in the supporting convex member 152 while keeping the boundary surface as described above, a gap 159 is generated between an exterior part of the supporting convex member 152 provided for keeping the boundary surface and an inner space provided for placing the part of the image reading device 31 as illustrated in FIGS. 12 and 14. According to example embodiments, the gap 159 is formed in the vicinity of the upper surface 152*a* and the slip prevention portion 154*a*, both of which are provided in the front portion of the supporting convex member 152, relative to the sliding direction Xb. For example, the gap 159 is surrounded by three wall surfaces, a pair of side walls 152*c* and 152*d* formed in the vicinity of the front edge of the supporting convex member 152 along the sheet discharging direction Xa and the sliding direction Xb, and a front wall 152*e* formed in the vicinity of the front edge of the supporting convex member 152 along a sheet width direction Y. The vicinity of the front edge of the supporting convex member 152 is integrally formed with the pair of side walls 152*c* and 152*d*, and the front wall 152*e*, in order to increase strength of the supporting convex member 152, for example, the slip prevention portion 154*a*.

The user may catch a finger in a gap between the gap 159 and a front wall of the image reading device 31 when the image reading device 31 is slid to the front, possibly causing serious injury. Accordingly, members and mechanisms for selectively covering the opening 159 when the image reading device 31 is slid to the front are required for preventing the user from accessing the front portion of the supporting convex member 152.

Figure 19A:
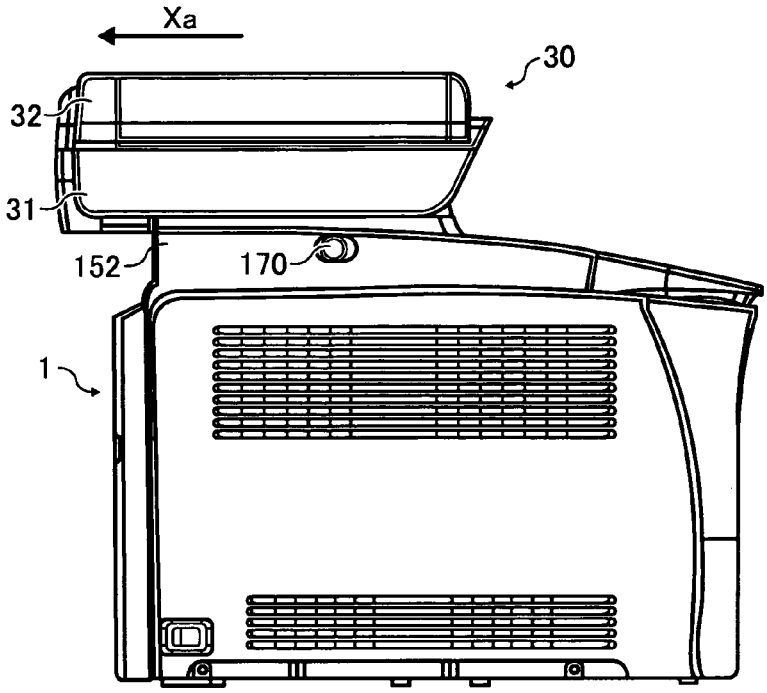
FIG. 19A is a side view illustrating the image forming apparatus when the image reading device is slid to the back of the supporting convex members.
Figure 19B:
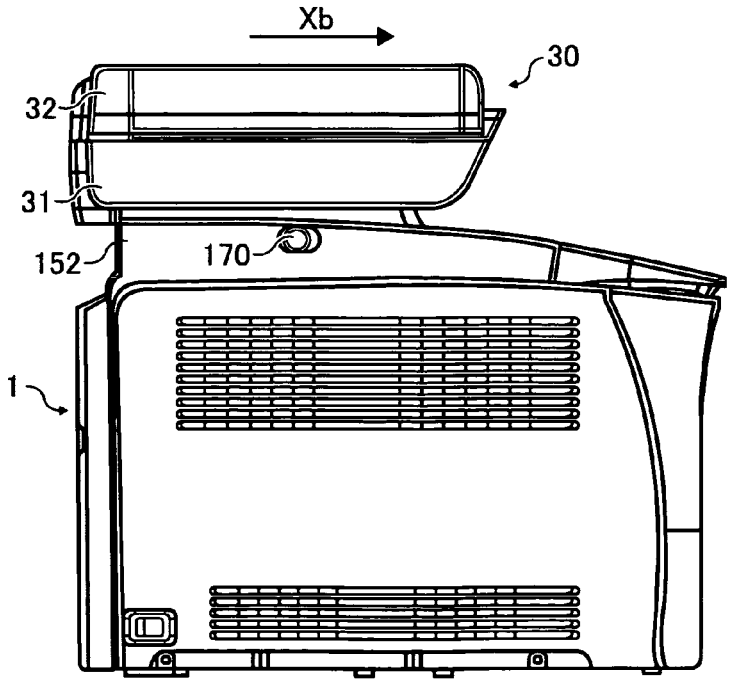
FIG. 19B is a side view illustrating the image forming apparatus when the image reading device is slid to the front of the supporting convex members.

FIG. 19A is a side view illustrating the image forming apparatus when the operation button 170 is pressed so that the image reading device 31 including the automatic document feeder 32 is slid to the back in the sheet discharging direction Xa. FIG. 19B is a side view illustrating the image forming apparatus when the operation button 170 is pressed so that the image reading device 31 including the automatic document feeder 32 is slid to the front in the sliding direction Xb.

Figure 20:
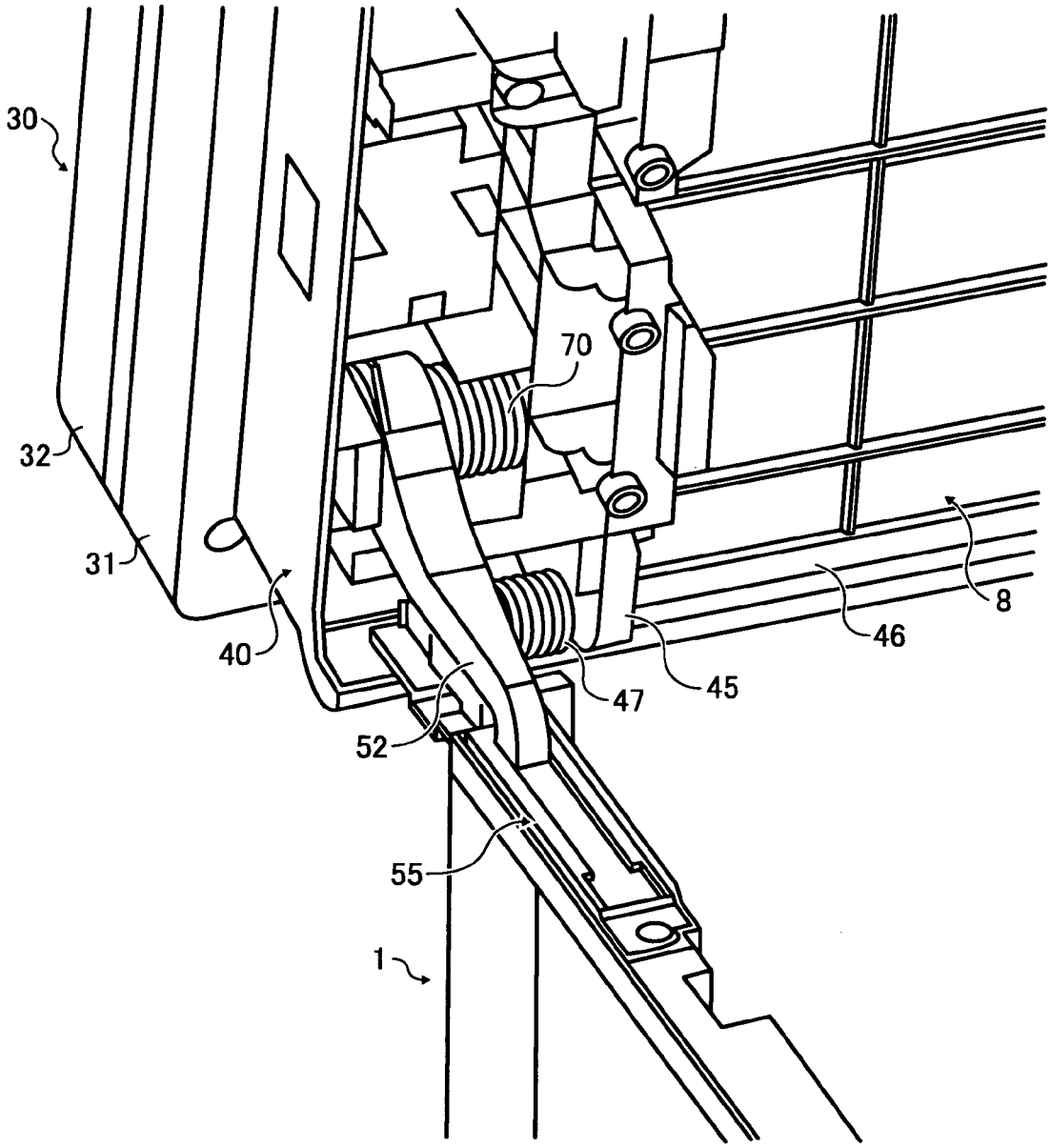
FIG. 20 is an enlarged perspective view illustrating an upper frame opening and closing mechanism on the left according to example embodiments when the upper frame is in an opened position as illustrated in FIG. 3.

FIG. 20 is an enlarged view illustrating a left portion of the upper frame opening and closing mechanism according to example embodiments when the upper frame 30 is opened as illustrated in FIG. 3.

Figure 38A:
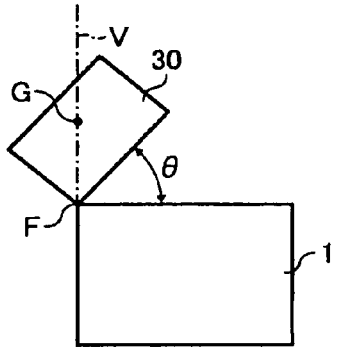
FIG. 38A is a diagram illustrating an inversion angle θ.
Figure 38B:
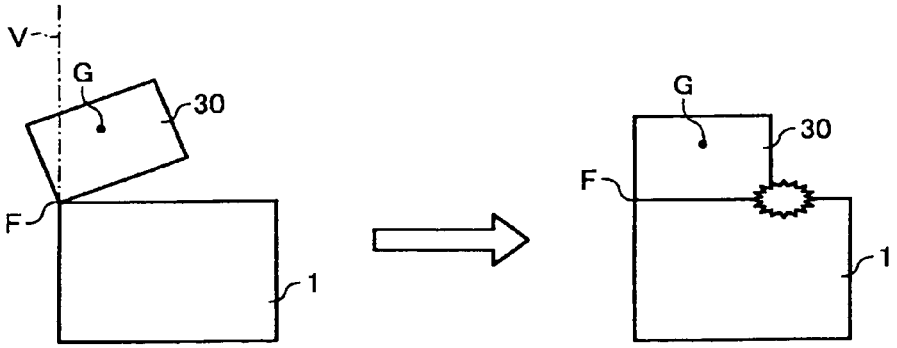
Background Art FIG. 38B
FIG. 38B is a diagram illustrating a state in which the upper frame is released during the opening motion before the opening angle exceeds the inversion angle θ.
Figure 38C:
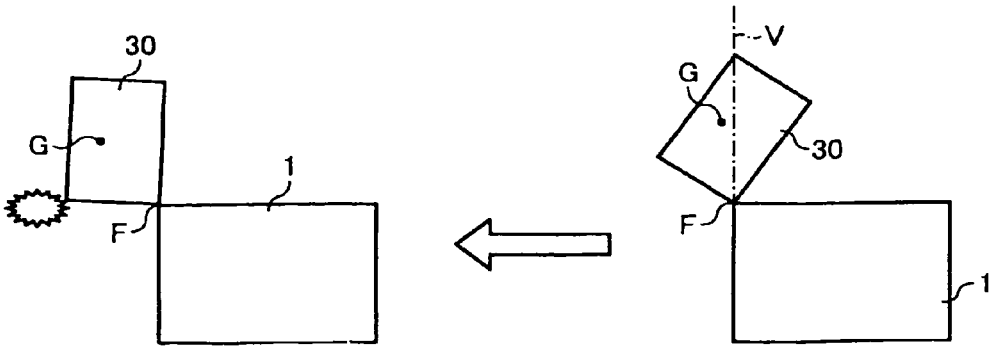
Background Art FIG. 38C
FIG. 38C is a diagram illustrating a state in which the upper frame is released during the opening motion when the opening angle exceeds the inversion angle θ.

The upper cover 40 includes a pair of upper frame members 45 on both sides of the laser scanning device 8. Both ends of the hinge 46 are passed through the pair of the upper frame members 45. The hinge 46 is supported by the main body 1 along an upper edge on the back surface of the main body 1. Thereby, the upper frame 30 is pivotally attached to the main body 1 on the hinge 46. As illustrated in FIG. 38C, when the upper frame 30 is opened at an angle greater than the inversion angle θ, the upper frame 30 receives a moment in an opening direction due to gravity. Accordingly, if the upper frame 40 is released at such an angle during the opening motion, the upper frame 40 is opened by gravity, and the image forming device 2 is exposed.

A pivot spring 47, which may be a torsion spring, is provided to both edges of the hinge 46 passing out of the pair of the upper frame members 45. One edge of the pivot spring 47 is hooked to the main body 1, and the other end thereof is hooked to the upper frame 30. The pivot spring 47 biases the upper frame 30 in the opening direction of the upper frame 30.

Figure 21:
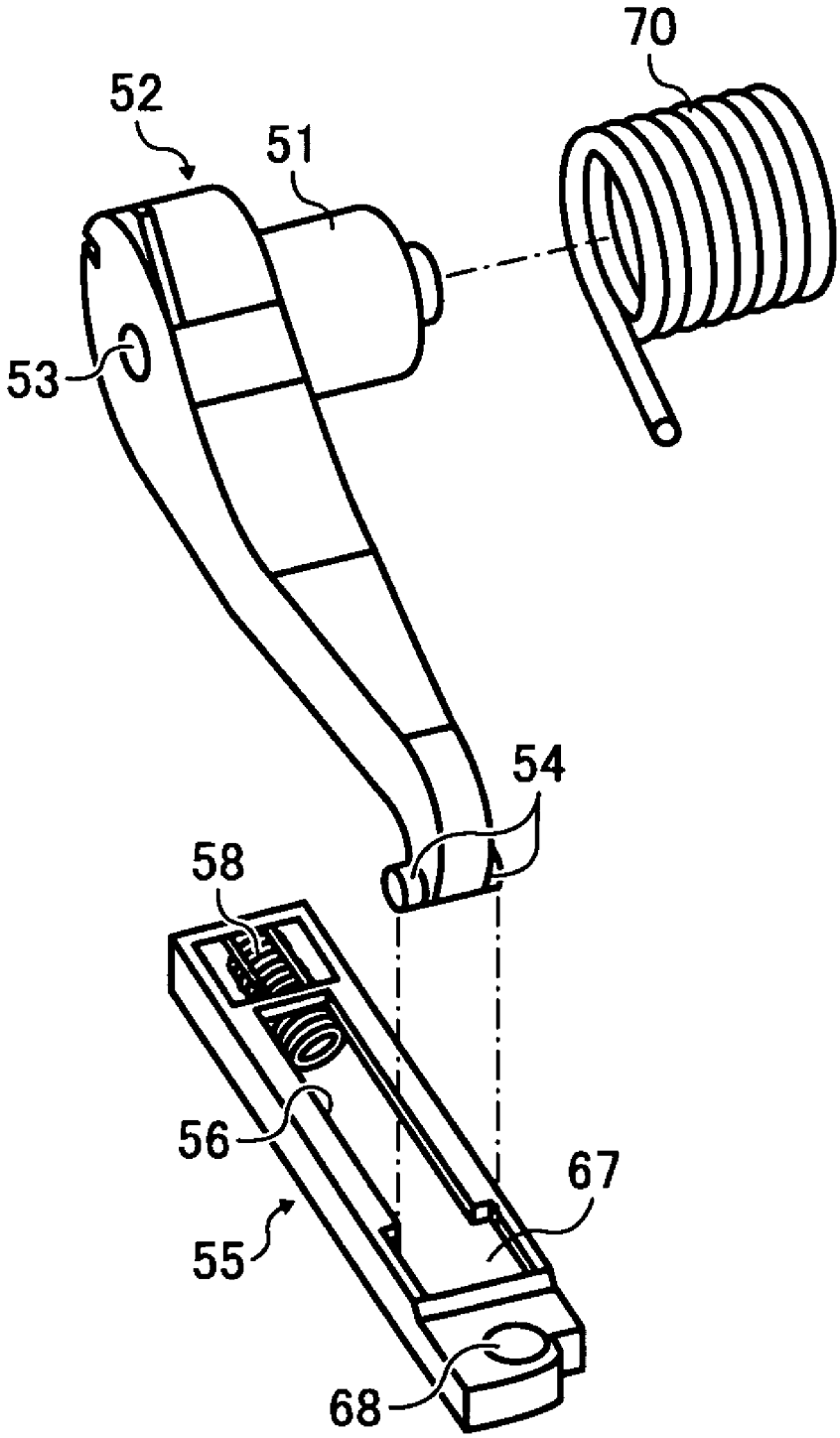
FIG. 21 is an exploded view illustrating the upper frame opening and closing mechanism.

Arm members 52 are respectively provided on outer sides of the pair of the upper frame members 45. Referring to FIG. 21, each of the arm members 52 includes a cylindrical portion 51 on a base end thereof, and a socket 53 passing through the arm member 52 to the cylindrical portion 51. The arm member 52 is supported by a shaft, not shown, inserted into the socket 53, so that the base end of the arm member 52 is pivotally provided to the upper frame 30. A leading edge of the arm member 52 is bent into a hook shape, and cylindrical protrusions 54 are provided on both sides of the leading edge of the arm member 52.

An arm spring 70 such as a torsion spring serving as a biasing member is wound around the cylindrical portion 51 of the arm member 52. One edge of the arm spring 70 is hooked to the arm member 52 and the other end thereof is hooked to the upper frame 30. The arm spring 70 is provided on the base end of the arm member 52, and pivotally biases the arm member 52 such that a moment in the opening direction is applied to the arm member 52 initially when the upper frame 30 is opened, and the direction of the moment is reversed on the way in the opening motion so that the moment in the closing direction is applied to the arm member 52.

Additional space is not necessary when the arm spring 70 is provided in the supporting convex parts 50 of the upper cover 40. Thus, the arm member 70 can be effectively provided in the supporting convex parts 50, providing a space saving configuration.

Figure 22A:
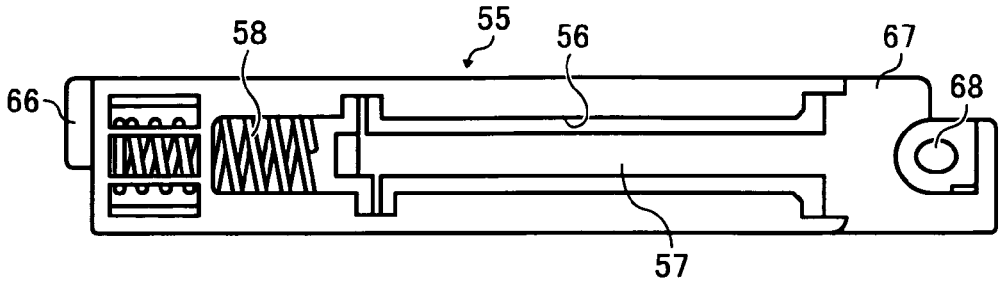
FIG. 22A is a plan view illustrating a rail member provided in the upper frame opening and closing mechanism.
Figure 22B:
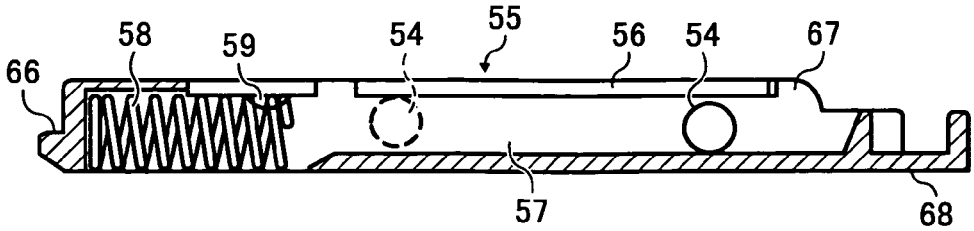
FIG. 22B is a vertical-sectional view illustrating the rail member provided in the upper frame opening and closing mechanism.

Each of rail members 55 having a narrow shape is provided on right and left edges of the main body 1. As illustrated in FIGS. 22A and 22B, a linear slit 56 is provided on the top of the rail member 55 in a longitudinal direction, and a guide groove 57 is provided in the rail member 55. A compression coil spring 58 serving as a cushion member is provided at the back of the guide groove 57, which is an end edge of the rail member 55. An outside diameter of the compression coil spring 58 is longer than a width of the linear slit 56, so that the compression coil spring 58 is prevented from coming out of the guide groove 57. A click protrusion 59 is extended downward from the top of the rail member 55. A fitting protrusion 66 is formed on the outside of the end edge of the rail member 55, and an entry opening 67 of the guide grove 57 and a screw insertion hole 68 are provided at the leading edge of the rail member 55.

Each of the rail members 55 is placed on the right and left edges of the main body 1 such that the fitting protrusion 66 is located at the back, and the entry opening 67 is located at the front as illustrated in FIG. 20. The fitting protrusion 66 is fitted into the main body 1 so that the rail member 55 is fixed to the main body 1 with a mounting screw inserted through the screw insertion hole 68.

Thereafter, the cylindrical protrusions 54 provided on the both sides of the leading edge of the arm member 52 are inserted into the guide groove 57 from the entry opening 67. The arm member 52 pivots along with the opening and closing of the upper frame 30, and the cylindrical protrusions 54 are guided by the guide groove 57 so as to pass the linear slit 56 back and forth as illustrated in FIG. 22B with solid and dotted lines. Thus, the leading edge of the arm member 52 is guided by the guide groove 57. When the upper frame 30 is fully opened, the compression coil spring 58 is compressed by the cylindrical protrusions 54. At this time, the leading edge of the arm member 52 is designed to be bent into a hook shape so that the cylindrical protrusions 54 press the compression coil spring 58 in a compression direction. Accordingly, the compression coil spring 58 can be compressed in a straight line.

The cylindrical protrusions 54 inserted into the guide groove 57 move in contact with the bottom of the rail member 55 as indicated by the solid line in FIG. 22B due to a larger load applied from the upper frame 30 when inserted from the entry opening 67. Meanwhile, the cylindrical protrusions 54 move in contact with the top of the rail member 55 as indicated by the dotted line in FIG. 22B due to a smaller load applied from the upper frame 30 when passing to the back of the guide groove 57.

When the upper frame 30 is opened at an angle close to the maximum opening angle, the cylindrical protrusions 54 pass over the click protrusion 59. Accordingly, the upper frame 30 can be prevented from being fully opened at once, and the user notices that the opening angle of the upper frame 30 is close to the maximum opening angle. In place of the compression coil spring 58, cushion members formed of polyurethane elastomer, urethane foam, rubber, oil damper, and so forth, may be used.

Figure 23:
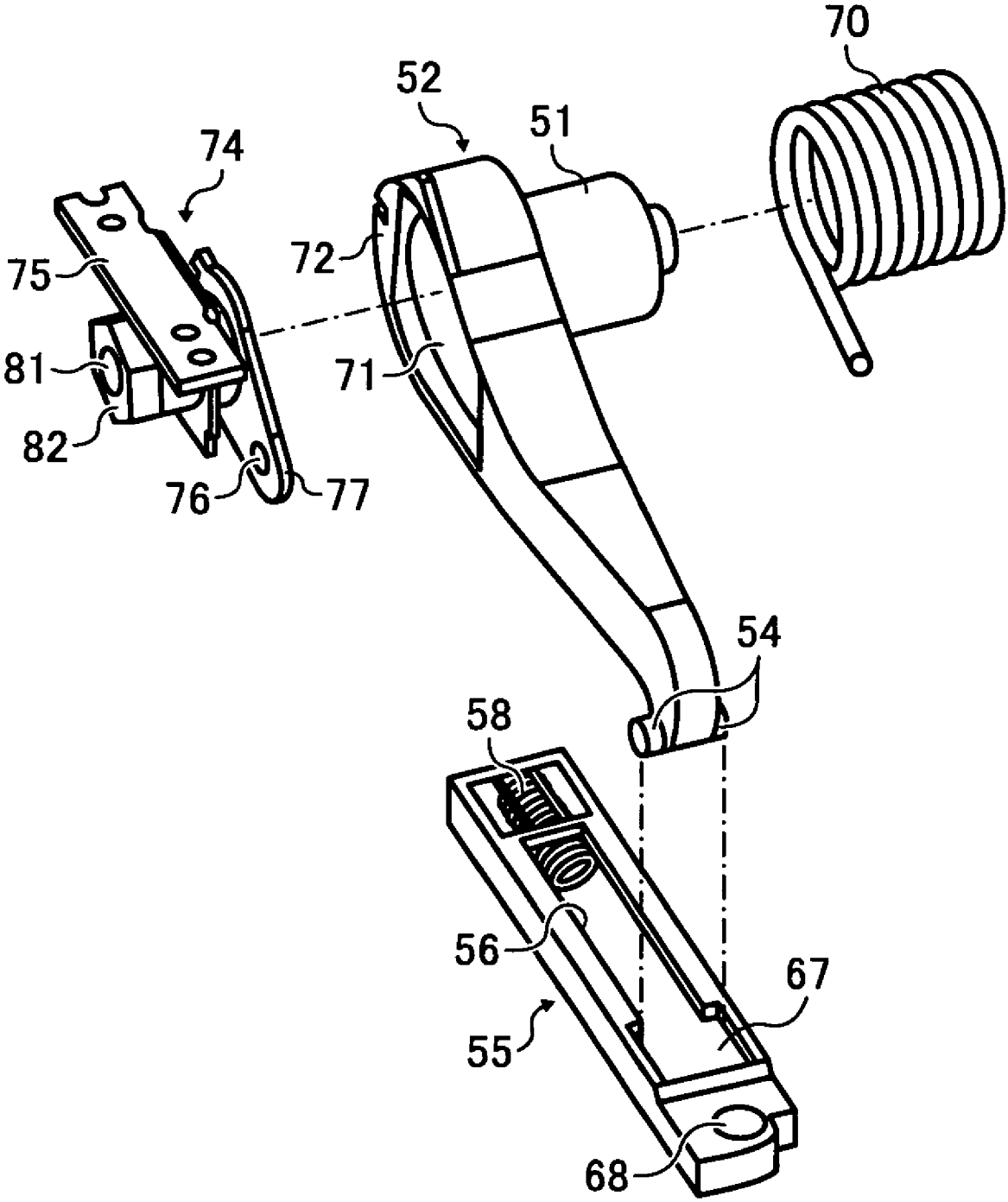
FIG. 23 is an exploded view illustrating another example of the upper frame opening and closing mechanism according to example embodiments.
Figure 24:
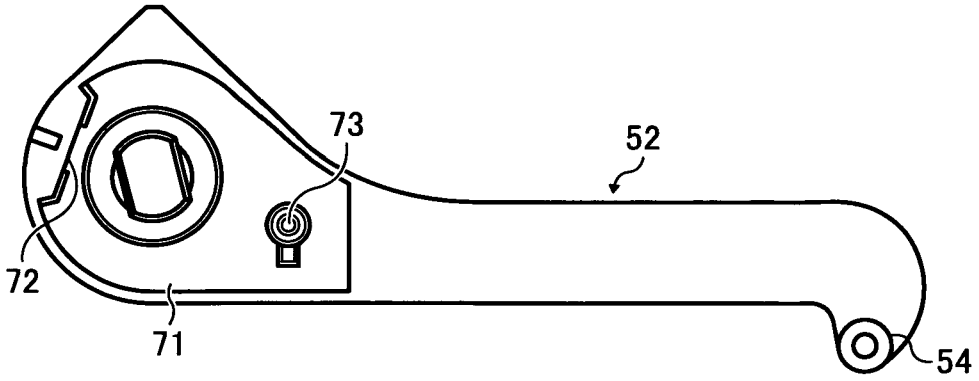
FIG. 24 is a side view illustrating an arm member used in the upper frame opening and closing mechanism illustrated in FIG. 23.

Referring to FIGS. 23 and 24, a concave portion 71 may be provided on one side of the base end of the arm member 52. A torque generating member 74 is provided in the concave portion 71 with a locking part 72 and a screw hole 73.

Figure 25:
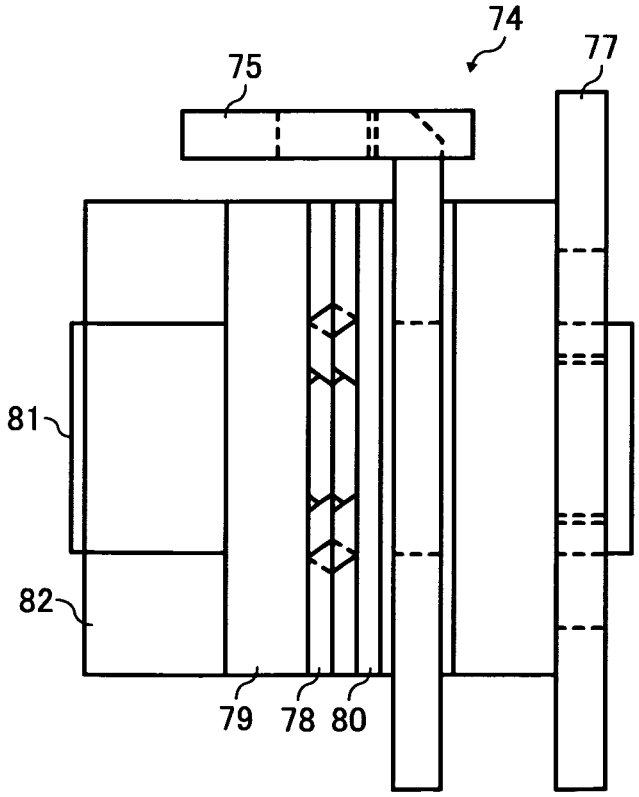
FIG. 25 is an enlarged plan view illustrating a torque generating member used in the upper frame opening and closing mechanism illustrated in FIG. 23.

A torque hinge is used as the torque generating member 74 according to example embodiments. The torque generating member 74 includes a mounting bracket 75 including an L-shaped plate, and an arm mounting member 77 having a plate-like shape to which a screw insertion hole 76 is provided. Referring to FIG. 25, the torque generating member 74 further includes a flat spring 78 serving as a biasing member, two washers 79 and 80 for holding the flat spring 78 therebetween, a supporting shaft 81 provided on the outside of the arm mounting member 77 for supporting the flat spring 78 and the washers 79 and 80 on the shaft thereof, and a nut 82 serving as a fastening member screwed at an end of the supporting shaft 81. The mounting bracket 75 is mounted on the upper frame 30. The arm mounting member 77 is inserted in the concave portion 71 of the arm member 52, and a part of the arm mounting member 77 is locked with the locking part 72. A mounting screw, not shown, is inserted in the screw insertion hole 76, and is screwed at the screw hole 73. Thus, the arm mounting member 77 is mounted on the arm member 52. The flat spring 78 held between the washers 79 and 80 is bent by fastening the nut 82, so that the mounting bracket 75 and the arm mounting member 77 are pressed against each other to generate a load torque T.

Figure 26A:
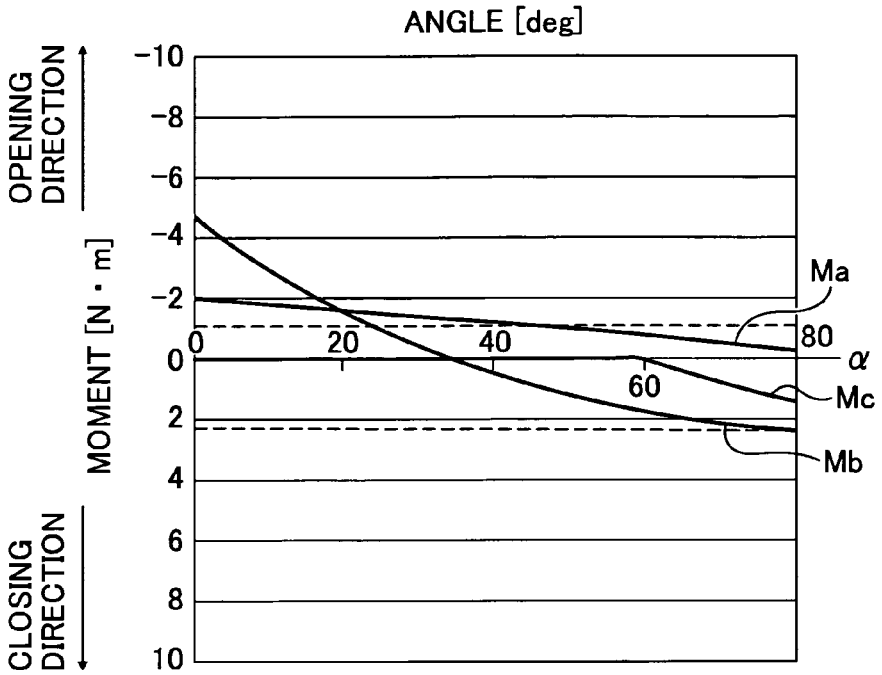
FIG. 26A is a graph illustrating a relation between an opening angle α of the upper frame, a moment Ma generated from a biasing force of a pivot spring, a moment Mb generated from a biasing force of an arm spring, and a moment Mc generated from a biasing force of a compression coil spring.
Figure 26B:
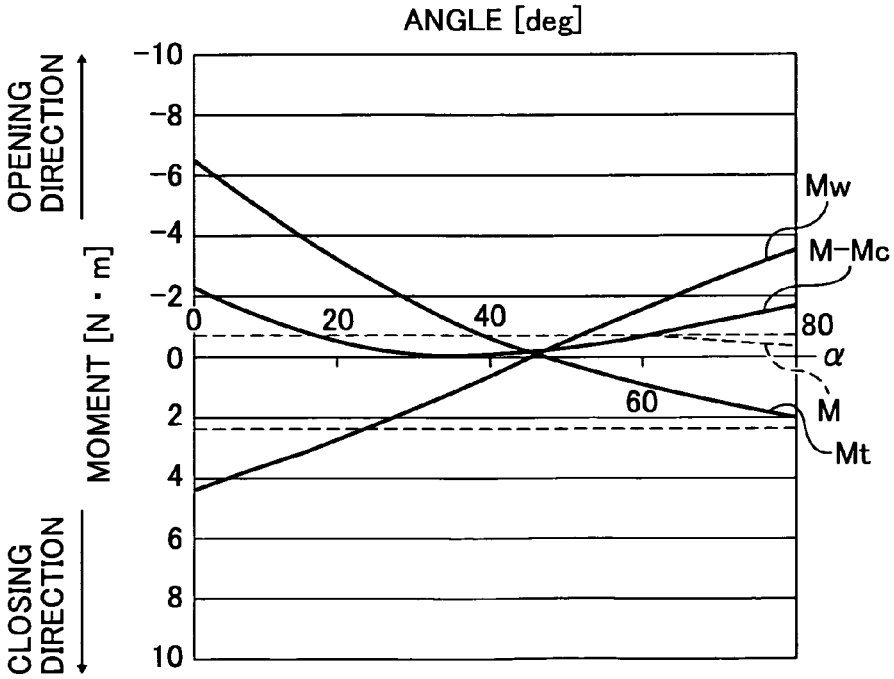
FIG. 26B is a graph illustrating a relation between the opening angle α of the upper frame, a composite moment Mt of the moments Ma, Mb, and Mc, a moment Mw generated from the weight of the upper frame, and a composite moment M of the moments Mt and Mw.

FIG. 26A is a graph illustrating a relation between an opening angle $\alpha$ of the upper frame 30 and moments Ma, Mb, and Mc. The moment Ma generates from a biasing force applied from the pivot spring 47 serving as a biasing member provided to the both edges of the hinge 46. The moment Mb generates from a biasing force applied from the arm spring 70 serving as a biasing member. The moment Mc generates from a biasing force applied from the compression coil spring 58 serving as a cushion member. FIG. 26B is a graph illustrating a relation between the opening angle $\alpha$ of the upper frame 30, a synthetic moment Mt, a moment Mw, and a synthetic moment M. The synthetic moment Mt represents a moment in which the moments Ma, Mb, and Mc are combined. The moment Mw generates from the weight of the upper frame 30. The synthetic moment M represents a moment in which the moments Mt and Mw are combined. In the arm spring 70, a switching angle of the moment Mb is set close to 0°, and a larger spring coefficient is set. Thereby, an upward biasing force can be sufficiently kept at an angle around 0°, and a switching angle of the moment Mt can be set almost the same as that of the moment Mw, consequently, the moment M can be set around 0 Nm regardless of the opening angle $\alpha$. As a result, the user can easily open the upper frame 30 upward with a smaller force, resulting in an improvement in the opening motion of the upper frame 30.

Figure 27:
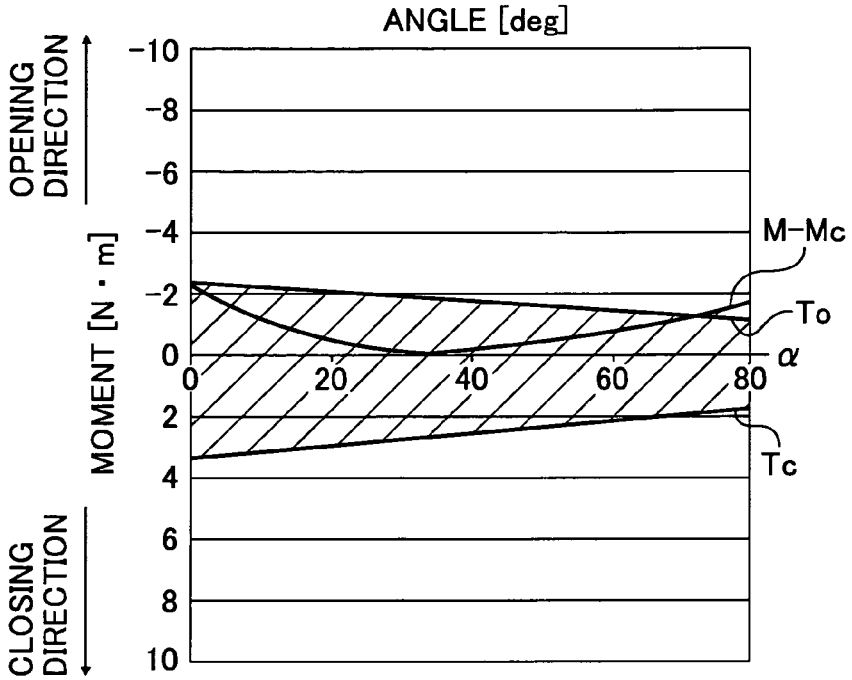
FIG. 27 is a graph illustrating a relation between the opening angle α of the upper frame, the moment M applied to the upper frame, and a load torque T generated by the torque generating member when the compression coil spring is not provided.
Figure 28:
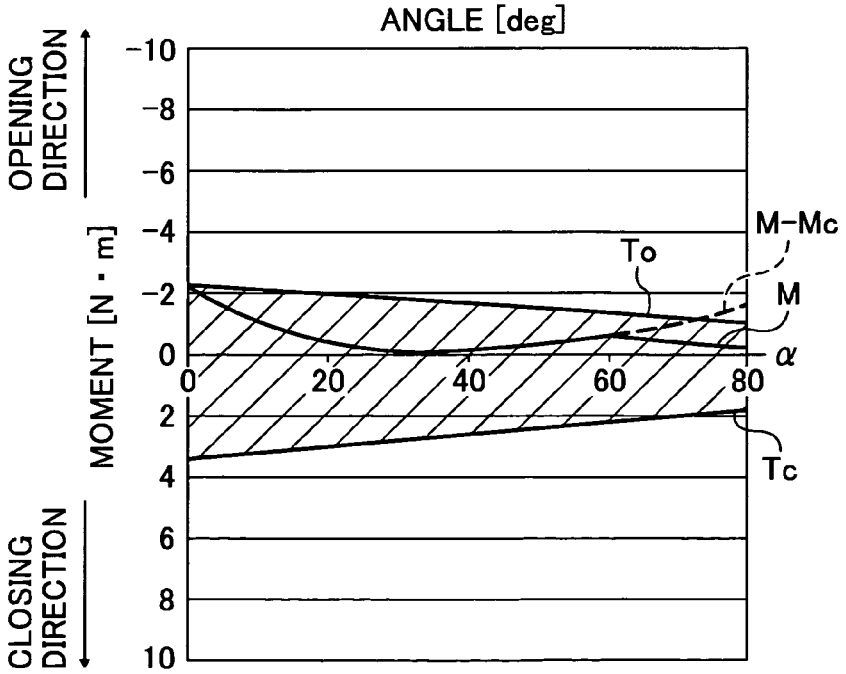
FIG. 28 is a graph illustrating the relation illustrated in FIG. 27 when the compression coil spring is provided.

FIG. 27 is a graph illustrating a relation between the opening angle $\alpha$ of the upper frame 30, the moment M-Mc applied to the upper frame 30, which is the same as that illustrated in FIG. 26B, and the load torque T generated from the torque generating member 74 when the compression coil spring 58 is not provided. FIG. 28 is a graph illustrating a relation between the opening angle $\alpha$ of the upper frame 30, the moment M applied to the upper frame 30, which is the same as that illustrated in FIG. 26B, and the load torque T generated from the torque generating member 74 when the compressing coil spring 58 is provided. In FIGS. 27 and 28, To represents a load torque T generated from the torque generating member 74 when the upper frame 30 is opened, and Tc represents a load torque T generated from the torque generating member 74 when the upper frame 30 is closed. In the torque generating member 74, a torque ratio of To to Tc is set at 10 to 7.

As illustrated in FIG. 27, in a case in which the compression coil spring 58 is not provided, a right end of a curve representing the moment M-Mc when the upper frame 30 is pivotally opened at around the maximum opening angle relative to the main body 1, also indicated with a dotted line in FIG. 28, is above a range of the load torque T indicated by an shaded area. Therefore, when the user releases the upper frame 30 at around the maximum opening angle during the opening motion, the upper frame 30 is pivoted further in the opening direction under its own weight, causing impact as illustrated in FIG. 38C. On the other hand, in a case in which the compression coil spring 58 pressed by the cylindrical protrusions 54 of the arm member 52 is provided for cushioning the opening motion of the upper frame 30, the moment M when the upper frame 30 is pivotally opened at around the maximum opening angle relative to the main body 1 is within the range of the load torque T as illustrated with a solid line in FIG. 28. Therefore, when the user releases the upper frame 30 at around the maximum opening angle during the opening motion, the upper frame 30 can be kept at that angle, completely preventing injury and impact. Because the compression coil spring 58 serving as a cushion member is provided separately from the biasing members such as the pivot spring 47 and the arm spring 70, a force and an effect of the compression coil spring 58 can be arbitrarily set regardless of the biasing members. Moreover, because the compression coil spring 58 is provided only on the end edge of the rail member 55, such a configuration can be downsized with lower costs, resulting in space and cost saving. Thus, the configuration described above can be effectively employed in a compact type image forming apparatus for home use. Furthermore, because the upper frame 30 can be opened beyond the inversion angle $\theta$, the above-described configuration can be effectively employed in an image forming apparatus in which the user can perform all operations from the front side thereof.

As described above, in a case in which the torque generating member 74 for operating the arm member 52 to apply the load torque T to the opening and closing of the upper frame 30 is provided, the torque generating member 74 generates the load torque T when the upper frame 30 is opened and closed relative to the main body 1. Accordingly, the curve representing the moment M is within the range of the load torque T as illustrated with the solid line in FIG. 28. As a result, the upper frame 30 can be more reliably prevented from pivoting backward and forward even if released by the user during the opening and closing, and can be securely kept at the angle where released by the user. Therefore, injury and impact can be more securely and reliably prevented as long as the user releases the upper frame 30 at the angle at which the moment M is within the range of the load torque T indicated by the shaded area in FIG. 28. Because the torque generating member 74 such as a torque hinge is provided only on the base end of the arm member 52, such a configuration can be downsized with lower costs, resulting in space and cost savings.

As described above, the user can easily open the upper frame 30 upward relative to the main body 1 by pulling up on the grip 61 to unlock the lock lever 60. However, if the compression coil spring 58 serving as a cushion member is not provided, the upper frame 30 is biased in the opening direction when fully opened as illustrated in FIG. 27. Therefore, the upper frame 30 swiftly opens with a biasing force, and the user needs to apply a larger force to close the upper frame 30. On the other hand, when the compressing coil spring 58 is provided, the right end of the curve representing the moment M is modified from the state indicated by the dotted line to the state indicated by the solid line as illustrated in FIG. 28. Accordingly, the upper frame 30 is biased in the closing direction, so that the biasing force in the opening direction can be suppressed, and the user can easily close the upper frame 30 with a smaller force. If the beginning of the curve representing the moment M lies beyond the range of the load torque T toward the opening direction at the opening angle $\alpha$ of around 0°, the upper frame 30 automatically opens to a certain angle when the user upholds the grip 61 to unlock the lock lever 60. Therefore, the user can more easily open the upper frame 30 with a smaller force.

Figure 29:
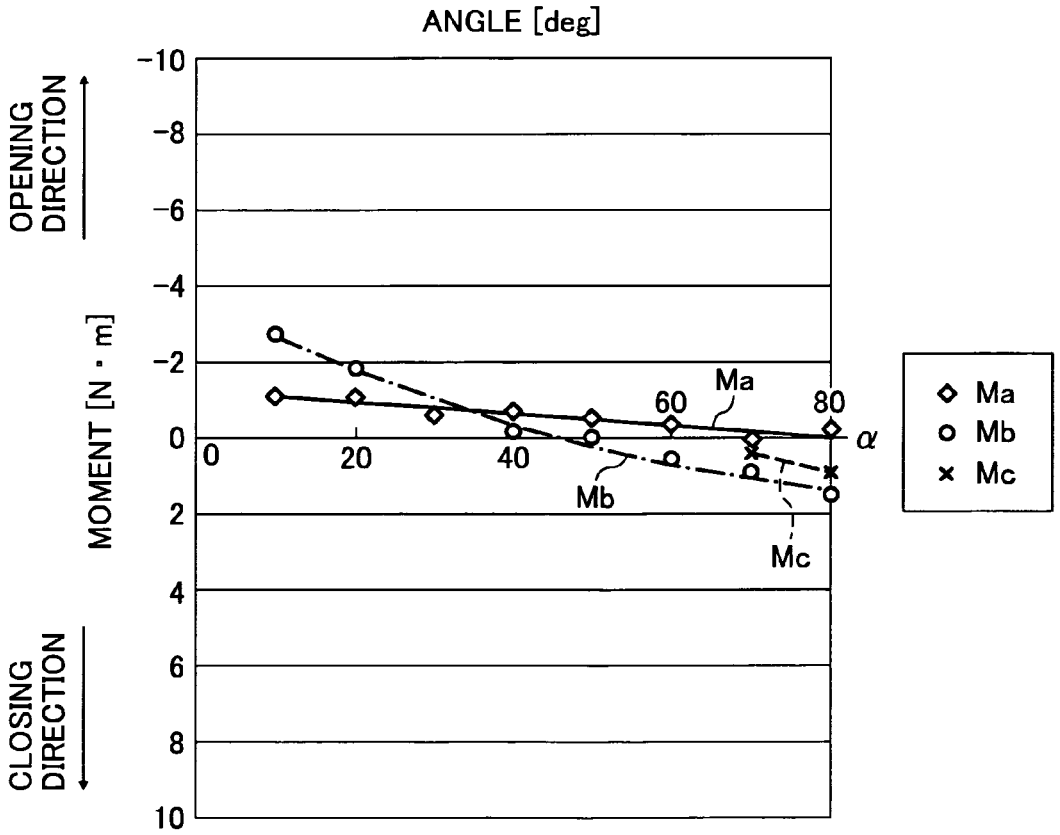
FIG. 29 is a graph illustrating the relation illustrated in FIG. 26A when the settings of the arm spring and the pivot spring are changed such that the arm spring is set to have a smaller spring coefficient, and a switching angle of the arm spring is changed toward the maximum opening angle of the upper frame as compared to the example illustrated in FIG. 26A.
Figure 30:
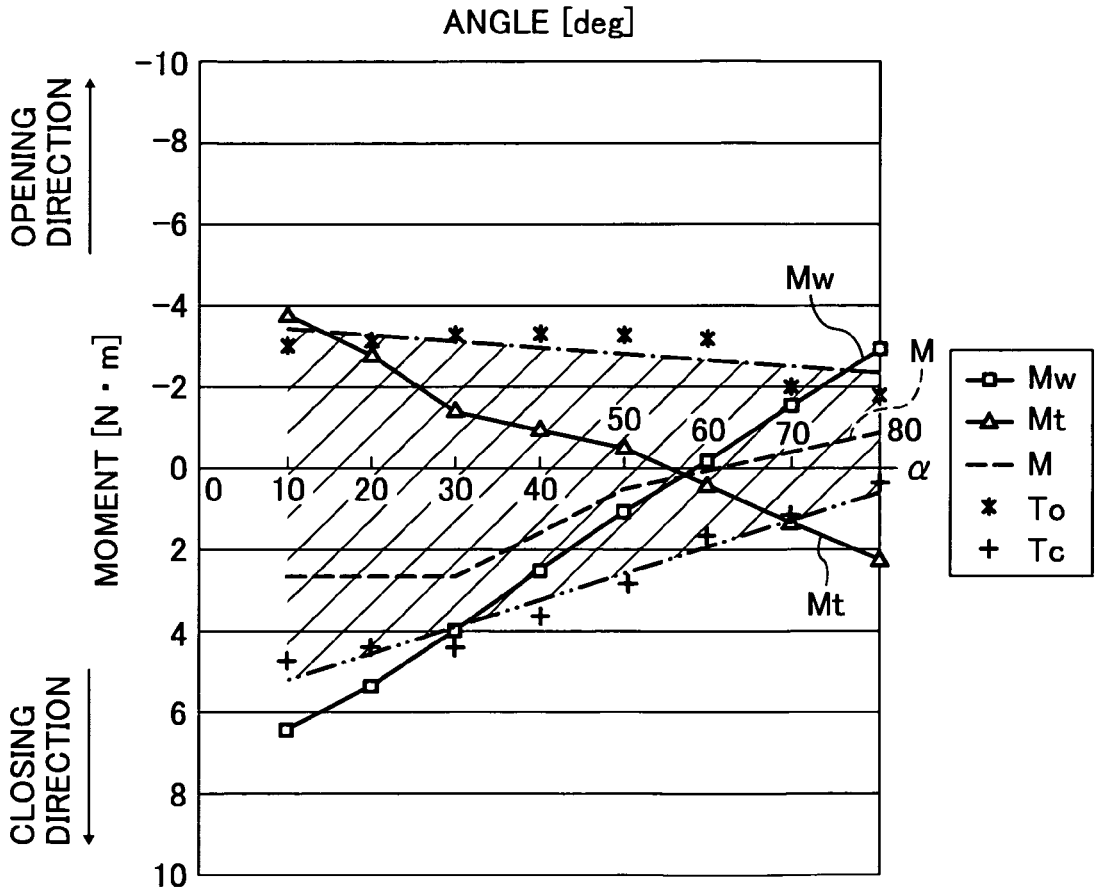
FIG. 30 is a graph illustrating the relation illustrated in FIG. 28 when the upper frame is positioned at the back of the supporting convex members.
Figure 31:
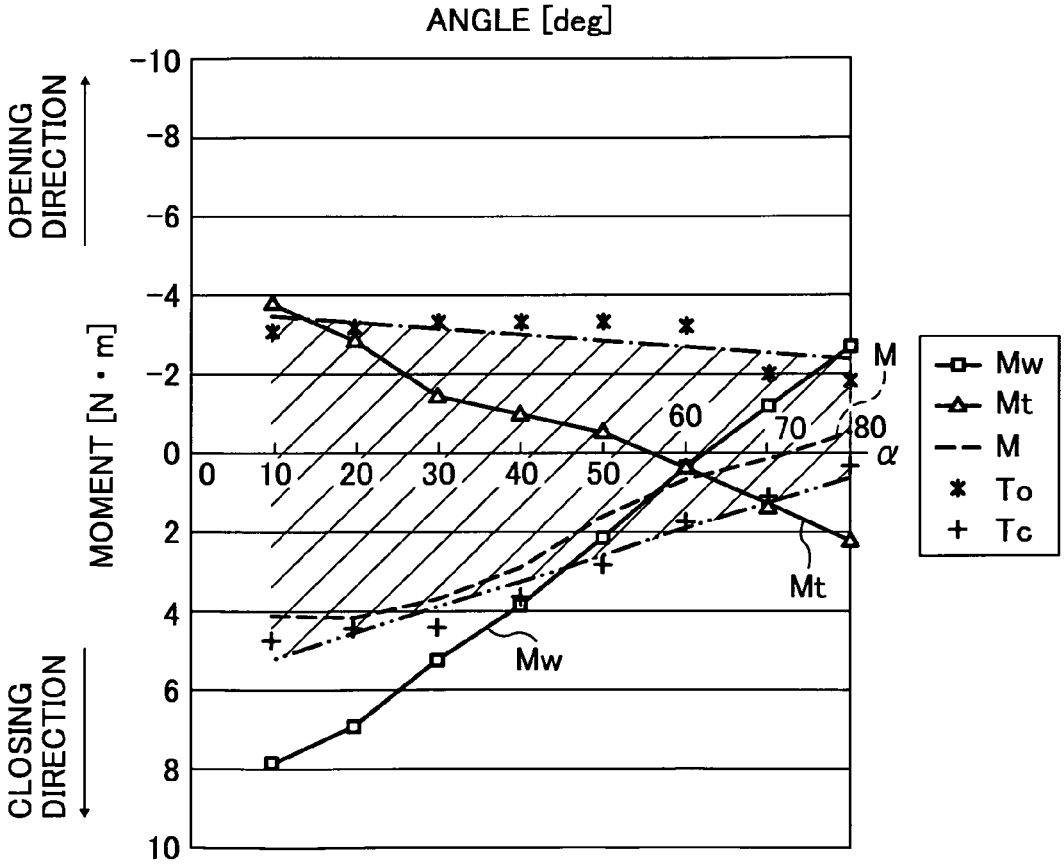
FIG. 31 is a graph illustrating the relation illustrated in FIG. 28 when the upper frame is positioned at the front of the supporting convex members.

FIGS. 29 through 31 are graphs illustrating the relations illustrated in FIGS. 26A and 28 when the settings of the arm spring 70 and the pivot spring 47 are changed.

In the example embodiments illustrated in FIGS. 26A and 28, the arm spring 70 is set to have a larger spring coefficient, resulting in an increase in a wire diameter and a coil inner diameter of the arm spring 70. Therefore, a larger space is required for allocating the arm spring 70. The space for the arm spring 70 can be reduced if the arm spring 70 is set to have a smaller spring coefficient. However, a force biased to the upper frame 30 in the opening direction is reduced at the opening angle $\alpha$ of around 0° if the arm spring 70 is set merely to have a smaller spring coefficient.

To solve such a problem, in example embodiments illustrated in FIGS. 29 through 31, the spring coefficient of the arm spring 70 is reduced so as to moderate a gradient from the opening direction to the closing direction of the moment Mb as illustrated in FIG. 29, and the switching angle of the arm spring 70 is changed toward the maximum opening angle of the upper frame 30 as compared to the example embodiments illustrated in FIGS. 26 through 28. With such a configuration, a force biased to the upper frame 30 in the opening direction can be sufficiently kept at the opening angle $\alpha$ of around 0°, and the wire diameter and the coil inner diameter of the arm spring 70 can be set smaller, resulting in space saving.

An amount of the load torque T generated by the torque generating member 74 can be increased without changing a size of the torque generating member 74. As long as the moment M positions within the range of the load torque T, the upper frame 30 can be kept at the angle where released by the user even if the spring force is decreased. Although the user needs a larger force to open the upper frame 30 upward with such a configuration, it is considered to be within tolerable limits. In example embodiments illustrated in FIGS. 29 through 31, one of the pivot spring 47 provided on the both ends of the hinge 46 is removed, thereby achieving further cost and space savings. Because the automatic document feeder 32 is provided on the left portion of the upper cover 40, the center of gravity of the upper frame 30 positions toward the left side thereof. Therefore, the pivot spring 47 provided on the left edge of the hinge 46, which is the side where the automatic document feeder 32 is located, is retained to keep the upper frame 30 balanced.

Referring back to FIG. 28, a difference between the moment M and the load torque T is smaller at around the maximum opening angle. Accordingly if the user releases the upper frame 30 when the upper frame 30 remains stationary at around the maximum opening angle, the upper frame 30 can be kept at that angle. However, if the user releases the upper frame 30 when the upper frame 30 does not remain stationary and is still biased in the opening direction, the upper frame 30 may be further opened beyond the maximum opening angle, causing impact as illustrated in FIG. 38C.

To solve such a problem, in the example embodiments illustrated in FIGS. 29 through 31, the range of the load torque T is set wider as illustrated in FIGS. 30 and 31 as compared to the example embodiment illustrated in FIG. 28. Accordingly, a difference between the moment M and the load torque T is larger at around the maximum opening angle of the upper frame 30 as compared to the example embodiment illustrated in FIG. 28. As a result, even if the user releases the upper frame 30 when the upper frame 30 does not remain stationary and is still biased in the opening direction at around the maximum opening angle, the upper frame 30 can be kept at that angle, preventing impact as illustrated in FIG. 38C.

The image reading device 31 to which the automatic document feeder 32 is provided is slidably attached to the upper cover 40, and the upper frame 30 including the upper cover 40 can be pivotally opened and closed relative to the main body 1 along with the image reading device 31 fixed to the upper cover 40 at the desired position. Therefore, the range of the load torque T is preferably set in consideration of the moment Mw when the image reading device 31 to which the automatic document feeder 32 is positioned at the front and the back.

For example, FIG. 30 is a graph illustrating the relation described above when the upper frame 30 is positioned at the back as illustrated in FIG. 19A, and FIG. 31 is a graph illustrating the relation described above when the upper frame 30 is positioned at the front as illustrated in FIG. 19B.

In the example embodiments illustrated in FIGS. 30 and 31, the load torque T is set such that the curve representing the moment M positions within the range of the load torque T when the upper frame 30 is located at the front and the back. Therefore, the upper frame 30 is prevented from being further opened beyond the maximum opening angle with a force as illustrated in FIG. 38C. In addition, the upper frame 30 is prevented from being swiftly closed with a force as illustrated in FIG. 38B.

Figure 32:
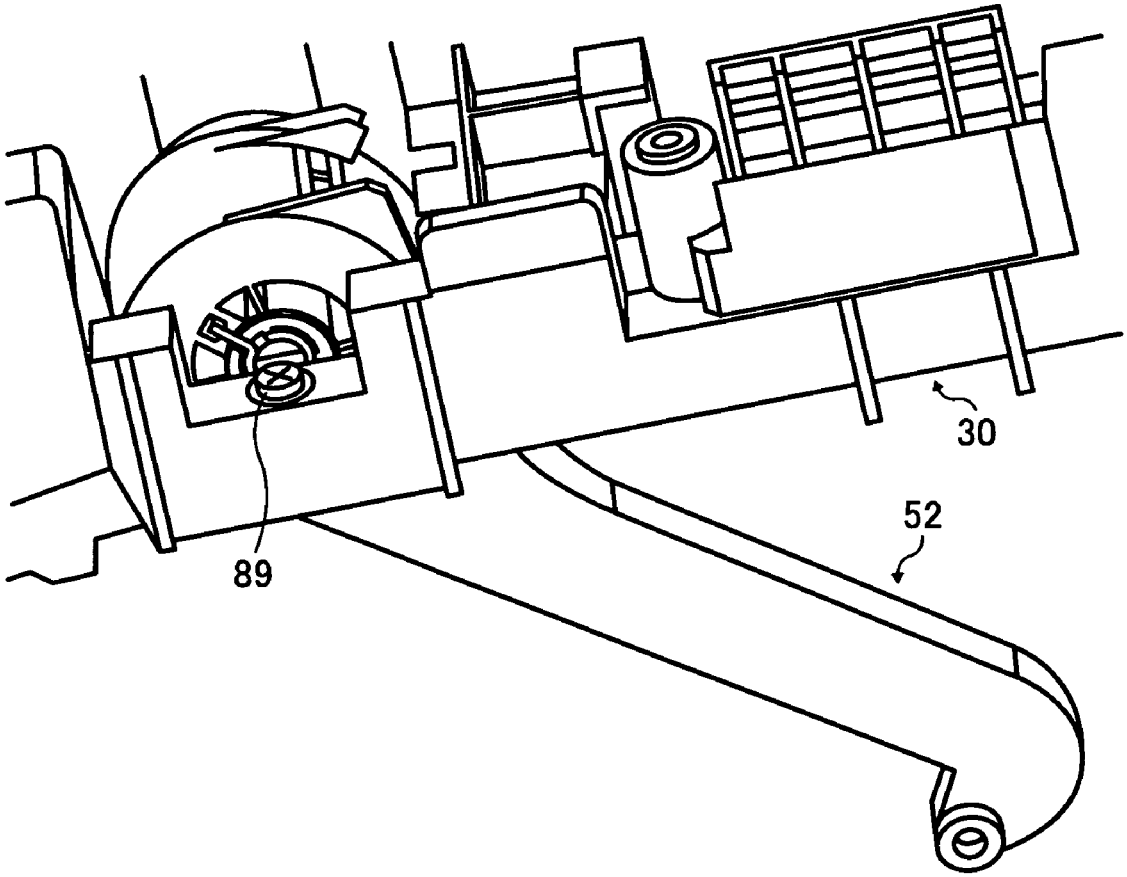
FIG. 32 is a perspective view illustrating another example of the torque generating member used in the upper frame opening and closing mechanism according to example embodiments.
Figure 33:
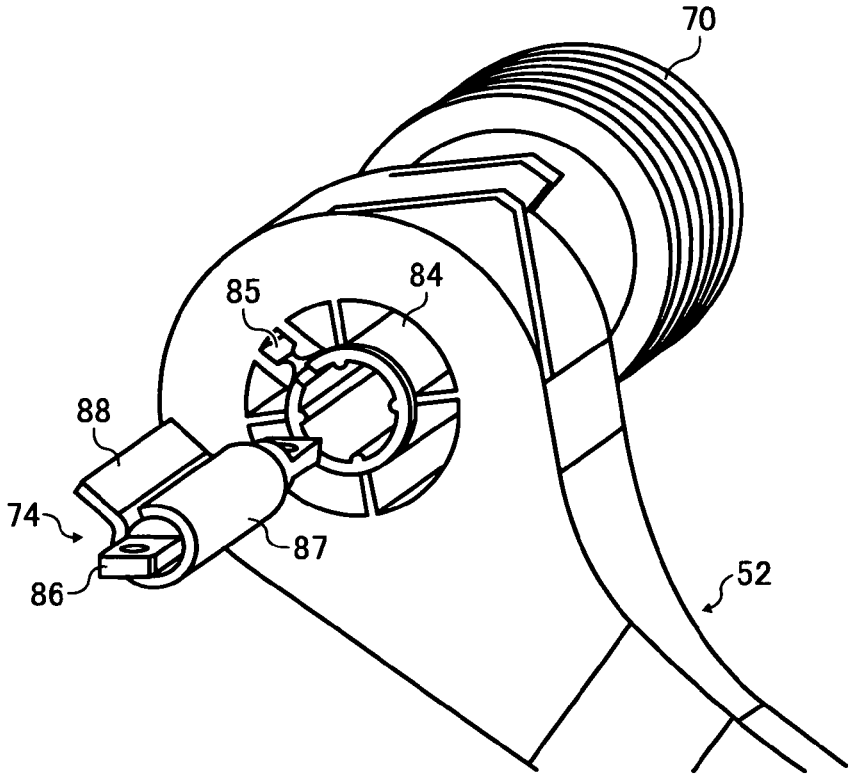
FIG. 33 is an exploded view illustrating a mounting portion of the arm member provided in the torque generating member illustrated in FIG. 32.

FIG. 32 is a schematic view illustrating another example of the torque generating member 74 employed in the upper frame opening and closing mechanism according to example embodiments. FIG. 33 is an exploded view illustrating a mounting portion of the arm member 52 provided in the torque generating member 74 illustrated in FIG. 32.

Referring to FIG. 33, the arm member 52 includes a cylindrical portion 84 on the base end thereof in a thickness direction, and an engaging groove 85 provided on an inner circumferential surface of the cylindrical portion 84 in a radial direction. The cylindrical portion 84 includes the torque generating member 74. A torque hinge including a metal shaft 86, both ends of which are flattened, and a sliding bracket 87, is used as the torque generating member 74. The metal shaft 86 is pressed into the sliding bracket 87, so that the sliding bracket 87 is provided around an outer circumference of the metal shaft 86. The sliding bracket 87 is formed by curling a metal spring, and includes an engaging protrusion 88 which is bent and protruding in a radial direction. The engaging protrusion 88 is engaged with the engaging groove 85, so that the metal shaft 86 on which the sliding bracket 87 is wound is inserted into the cylindrical portion 84. Each end of the metal shaft 86 is fixedly mounted on the upper frame 30 with a set screw 89 as illustrated in FIG. 32.

When the arm member 52 pivots along with the opening and closing of the upper frame 30, the load torque T is generated due to a friction between the metal shaft 86 and the sliding bracket 87. When the upper frame 30 is opened upward relative to the main body 1, the sliding bracket 87 tightens the metal shaft 86 so that a larger load torque T is generated. On the other hand, when the upper frame 30 is closed relative to the main body 1, the sliding bracket 87 releases the tightening of the metal shaft 86, so that a smaller load torque T is generated.

Thus, the biasing force from the pivot spring 47 and the arm spring 70 can be balanced with the load torque T generated by the torque generating member 74 with the above-described configuration. Consequently, injury and impact which may occur when the user releases the upper frame 30 during the opening and closing can be more securely and reliably prevented. As described above, the amount of the load torque T generated by the torque generating member 74 when the upper frame 30 is opened differs from that generated when the upper frame 30 is closed, so that the user can easily open and close the upper frame 30 relative to the main body 1 with a smaller force. For example, the amount of the load torque T generated by the torque generating member 74 can be appropriately changed based on the weight of the upper frame 30 without adversely affecting the opening and closing operations of the upper frame 30 by changing the curling direction of the sliding bracket 87, the force of the sliding bracket 87 for tightening the metal shaft 86, and the width of the sliding bracket 87.

Figure 34:
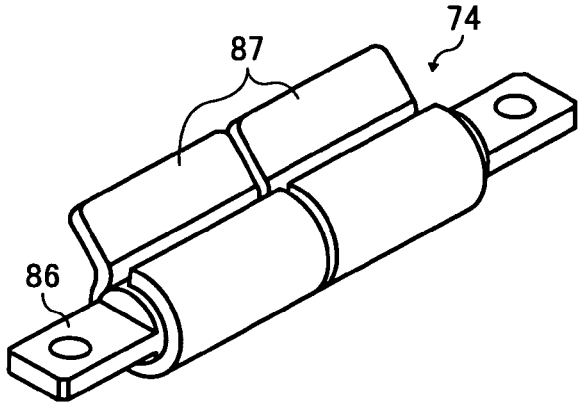
FIG. 34 is a perspective view illustrating another example of the torque generating member illustrated in FIGS. 32 and 33.

FIG. 34 is a schematic view illustrating another example of the torque generating member 74 illustrated in FIGS. 32 and 33. Referring to FIG. 34, the two sliding brackets 87 may be aligned around the metal shaft 86. It should be noted that although two sliding brackets 87 are depicted in FIG. 34, the number of sliding brackets 87 aligned around the metal shaft 86 is not limited thereto, and alternatively may be three or more.

Figure 35A:
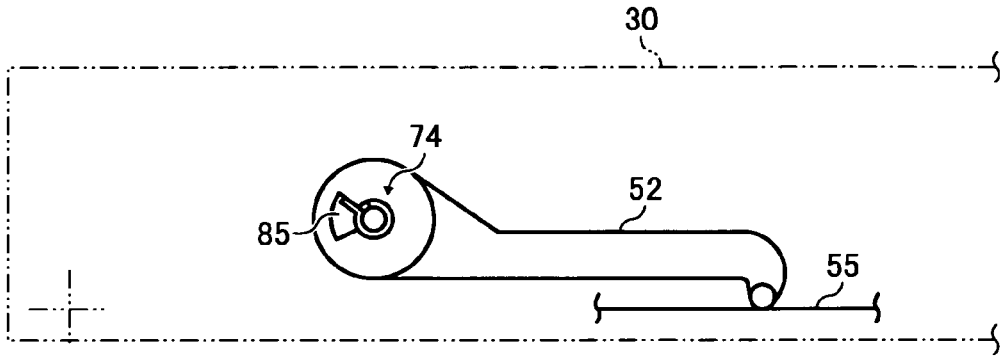
FIGS. 35A and 35B are side views illustrating operating states of yet another example of the torque generating member illustrated in FIGS. 32 and 33.
Figure 35B:
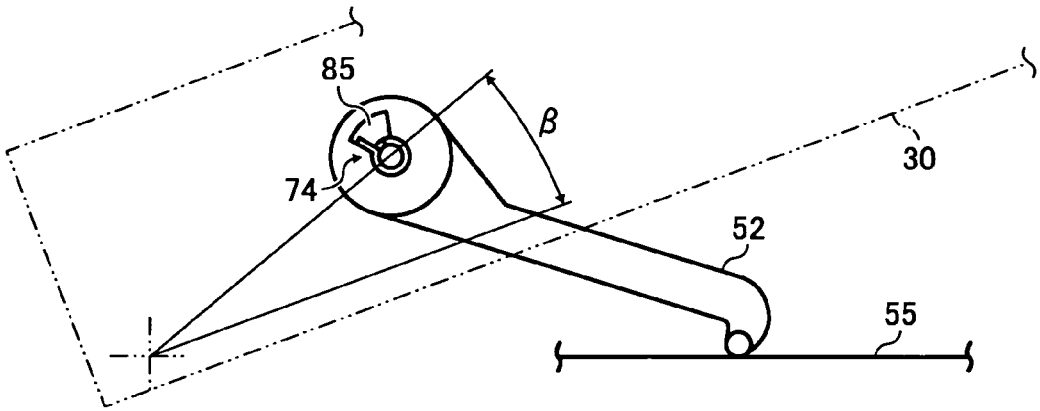

FIGS. 35A and 35B are side views illustrating operating states of yet another example of the torque generating member 74 illustrated in FIGS. 32 and 33. The torque generating member 74 illustrated in FIGS. 35A and 35B has the same configuration as that illustrated in FIG. 34, except that the engaging groove 85 provided in the arm member 52 has a fan-like shape. The torque generating member 74 does not generate the load torque T in the operating state illustrated in FIG. 35A when the upper frame 30 is in the closed position. Once the upper frame 30 is opened at a predetermined angle β as illustrated in FIG. 35B, the torque generating member 74 generates the load torque T. The torque generating member 74 with such a configuration generates a smaller load torque T at the beginning of the opening motion of the upper frame 30, and suppresses injury and impact which may occur when the upper frame 30 is released by the user at around the maximum opening angle during the opening motion. The load torque T may be generated by sequentially operating the plurality of the sliding brackets 87 provided around the metal shaft 86.

As described above, the metal shaft 86 is pressed into the sliding bracket 87 to form the torque generating member 74. However, the configuration of the torque generating member 74 is not limited to the above-described examples. For example, the torque generating member 74 may include an inner member and an outer member, both of which include a permanent magnet. The inner member and the outer member of the torque generating member 74 are respectively fixed to each of the upper frame 30 and the arm member 52. The load torque T may be generated between the inner member and the outer member by a magnetic force generated therebetween. Alternatively, the load torque T may be generated by a combination of the magnetic force and the friction between the metal shaft 86 and the sliding bracket 87 described above.

Figure 36:
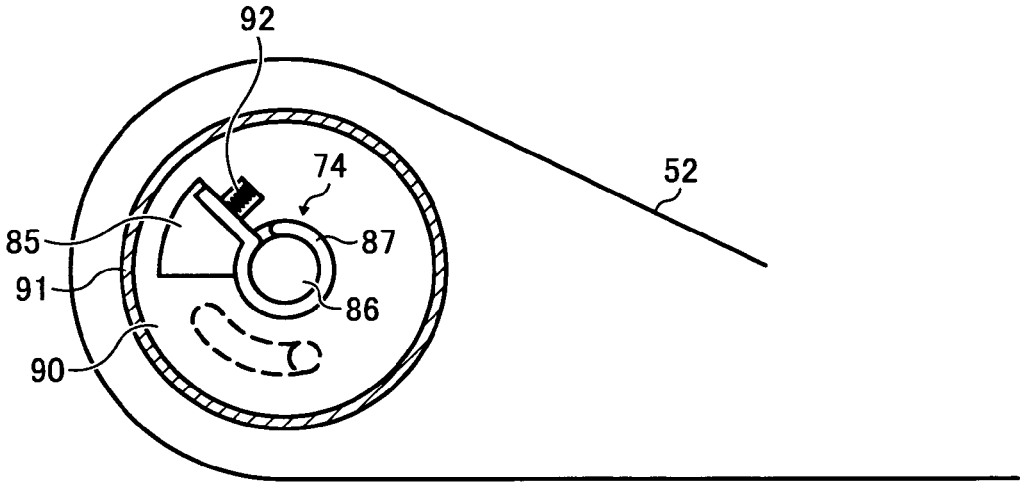
FIG. 36 is a schematic side view illustrating a yet another example of the torque generating member illustrated in FIGS. 32 and 33.

In a case in which the torque generating member 74 includes the engaging groove 85 having a fan-like shape provided to the arm member 52 as described above, the torque generating member 74 may not properly operate when the upper frame 30 is pivoted again in a direction originally pivoted after being pivoted opposite to the original direction. To solve such a problem, referring to FIG. 36, a portion 90 including the engaging groove 85 having a fan-like shape for transmitting a rotation torque generated from the sliding bracket 87 is engaged with the arm member 52 with a one-way clutch 91 for transmitting the rotation torque only in a single rotation direction therebetween. The engaging groove 85 is biased by a compression spring 92 in a rotatable direction of the one-way clutch 91.

Figure 37:
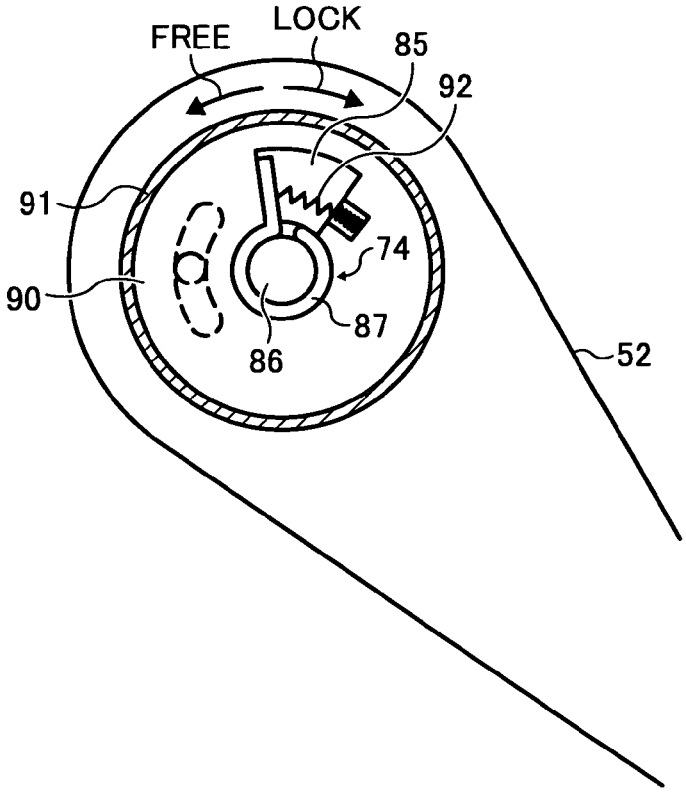
FIG. 37 is a schematic side view illustrating an operating state of the torque generating member illustrated in FIG. 36.

The torque generating member 74 operates as illustrated in FIG. 37. Consequently, even when the upper frame 30 is pivoted in a direction opposite to the original direction while the upper frame 30 is in the opening or closing motions, the portion 90 including the engaging groove 85 biased by the compression spring 92 returns to the original position thereof along with the movement of the sliding bracket 87. As a result, the load torque T can be reliably generated at the angle where the load torque T is required. The same effect can be obtained in a case in which a torsion coil spring is used for biasing the portion 90 including the engaging groove 85.

Example embodiments are not limited to the details described above, and various modifications and improvements are possible without departing from the spirit and scope of the present invention. It is therefore to be understood that, within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. An upper frame opening and closing mechanism, comprising:

an upper frame pivotally attached to a main body unit so as to be opened and closed on a hinge, which receives a moment in an opening direction due to gravity when the upper frame is opened at an angle exceeding an inversion angle so as to expose an interior of the main body unit;

an arm member, a base end of which is pivotally mounted on the upper frame;

a rail member mounted on the main body unit, to guide a leading edge of the arm member along with opening and closing of the upper frame;

a biasing member to bias the upper frame in the opening direction; and a cushion member provided to an end edge of the rail member, to be pressed by the leading edge of the arm member so as to cushion the opening of the upper frame when the upper frame is opened at a maximum opening angle relative to the main body unit.

2. The upper frame opening and closing mechanism according to claim 1, further comprising:

a torque generating member provided on the base end of the arm member, to operate with the arm member so as to apply a load torque to the upper frame in the opening and closing.

3. The upper frame opening and closing mechanism according to claim 2, wherein the torque generating member comprises a torque hinge, comprising:

a mounting bracket;

an arm mounting member;

a biasing member;

a supporting shaft to support the mounting bracket, the arm mounting member, and the biasing member on a shaft thereof; and a connecting member screwed at the supporting shaft to bend the biasing member so as to press the mounting bracket and the arm mounting member against each other, wherein the mounting bracket is mounted on the upper frame and the arm mounting member is mounted on the arm member.

4. The upper frame opening and closing mechanism according to claim 2, wherein the torque generating member comprises a torque hinge comprising:

a shaft; and a sliding bracket wound on the shaft to frictionally contact the shaft.

5. The upper frame opening and closing mechanism according to claim 4, wherein the shaft is mounted on the upper frame and the sliding bracket is engaged with the arm member.

6. The upper frame opening and closing mechanism according to claim 1, wherein the upper frame further comprises:

a sheet stacking surface to discharge sheets having images formed in the main body unit;

an upper cover comprising supporting convex parts provided on both sides of the sheet stacking surface; and an image reading device to read image data, slidably attached to the supporting convex parts in a sheet discharging direction.

7. The upper frame opening and closing mechanism according to claim 1, wherein the biasing member comprises an arm spring provided on a base end of the arm member to pivotally bias the arm member to apply a moment in an opening direction to the arm member initially, and subsequently apply a moment in a closing direction to the arm member on the way in the opening of the upper frame.

8. The upper frame opening and closing mechanism according to claim 7, wherein the upper frame comprises:

a sheet stacking surface to discharge sheets having images formed in the main body unit; and an upper cover comprising supporting convex parts provided on both sides of the sheet stacking surface, wherein the arm spring is provided in the supporting convex parts.

9. An image forming apparatus, comprising:

an image bearing member to bear an electrostatic latent image;

a charging device to charge a surface of the image bearing member;

an irradiating device to irradiate the charged surface of the image bearing member to form an electrostatic latent image thereon;

a developing device to develop the electrostatic latent image with a toner to form a toner image;

a transfer device to transfer the toner image onto a recording medium; and the upper frame opening and closing mechanism according to claim 1.

10. The image forming apparatus according to claim 9, wherein the upper frame of the upper frame opening and closing mechanism comprises:

a sheet stacking surface to discharge sheets having images formed in the main body unit;

an upper cover comprising supporting convex parts provided on both sides of the sheet stacking surface; and an image reading device to read image data, slidably attached to the supporting convex parts in a sheet discharging direction.

11. An upper frame opening and closing mechanism, comprising:

an upper frame pivotally attached to a main body unit so as to be opened and closed on a hinge, which receives a moment in an opening direction due to gravity when the upper frame is opened at an angle exceeding an inversion angle so as to expose an interior of the main body unit;

an arm member, a base end of which is pivotally mounted on the upper frame;

a rail member mounted on the main body unit, to guide a leading edge of the arm member along with opening and closing of the upper frame;

a biasing member to bias the upper frame in the opening direction; and a cushion member provided to an end edge of the rail member, to be pressed by the leading edge of the arm member so as to cushion the opening of the upper frame when the upper frame is opened at a maximum opening angle relative to the main body unit, wherein the rail member comprises:

a linear slit at the top thereof, thorough which the leading edge of the arm member passes; and a guide groove into which the leading edge of the arm member is inserted so as to move back and forth.

12. The upper frame opening and closing mechanism according to claim 11, wherein a compression coil spring serving as the cushion member is provided in a distal portion of the guide groove, which is the end edge of the rail member.

13. The upper frame opening and closing mechanism according to claim 12, wherein the leading edge of the arm member is bent in a hook-like shape to press the compression coil spring in a straight line.

14. An image forming apparatus, comprising:

an image bearing member to bear an electrostatic latent image;

a charging device to charge a surface of the image bearing member;

an irradiating device to irradiate the charged surface of the image bearing member to form an electrostatic latent image thereon;

a developing device to develop the electrostatic latent image with a toner to form a toner image;

a transfer device to transfer the toner image onto a recording medium; and the upper frame opening and closing mechanism according to claim 11.

15. An upper frame opening and closing mechanism, comprising:

an upper frame pivotally attached to a main body unit so as to be opened and closed on a hinge;

an arm member, a base end of which is pivotally mounted on the upper frame;

a rail member mounted on the main body unit, to guide a leading edge of the arm member along with opening and closing of the upper frame; and a biasing member to bias the upper frame in the opening direction, wherein the biasing member is configured to apply a biasing force to the upper frame to balance a moment applied to the upper frame based on gravity when the upper frame is opened at a maximum opening angle relative to the main body unit, wherein the rail member comprises:

a linear slit at the top thereof, thorough which the leading edge of the arm member passes; and a guide groove into which the leading edge of the arm member is inserted so as to move back and forth.

16. The upper frame opening and closing mechanism according to claim 15, wherein the upper frame further comprises:

a sheet stacking surface to discharge sheets having images formed in the main body unit;

an upper cover comprising supporting convex parts provided on both sides of the sheet stacking surface; and an image reading device to read image data, slidably attached to the supporting convex parts in a sheet discharging direction.

17. The upper frame opening and closing mechanism according to claim 15, wherein the rail member comprises:

a linear slit at the top thereof, thorough which the leading edge of the arm member passes; and a guide groove into which the leading edge of the arm member is inserted so as to move back and forth.

18. The upper frame opening and closing mechanism according to claim 17, further comprising a compression coil spring serving as a cushion member, the compression coil spring being in a distal portion of the guide groove, which is the end edge of the rail member.

19. The upper frame opening and closing mechanism according to claim 18, wherein the leading edge of the arm member is bent in a hook-like shape to press the compression coil spring in a straight line.

20. The upper frame opening and closing mechanism according to claim 15, wherein the biasing member comprises an arm spring provided on a base end of the arm member to pivotally bias the arm member to apply a moment in an opening direction to the arm member initially, and subsequently apply a moment in a closing direction to the arm member on the way in the opening of the upper frame.

21. The upper frame opening and closing mechanism according to claim 20, wherein the upper frame comprises:

a sheet stacking surface to discharge sheets having images formed in the main body unit; and an upper cover comprising supporting convex parts provided on both sides of the sheet stacking surface, wherein the arm spring is provided in the supporting convex parts.

22. An image forming apparatus, comprising:

an image bearing member to bear an electrostatic latent image;

a charging device to charge a surface of the image bearing member;

an irradiating device to irradiate the charged surface of the image bearing member to form an electrostatic latent image thereon;

a developing device to develop the electrostatic latent image with a toner to form a toner image;

a transfer device to transfer the toner image onto a recording medium; and the upper frame opening and closing mechanism according to claim 15.

* * * * *